US007112393B2

(12) United States Patent
Komoto et al.

(10) Patent No.: US 7,112,393 B2
(45) Date of Patent: Sep. 26, 2006

(54) NON-MAGNETIC TONER

(75) Inventors: Keiji Komoto, Shizuoka (JP); Yushi Mikuriya, Shizuoka (JP); Yuji Moriki, Shizuoka (JP); Yasushi Katsuta, Shizuoka (JP); Kenichi Nakayama, Shizuoka (JP); Takeshi Kaburagi, Shizuoka (JP); Emi Tosaka, Shizuoka (JP); Yasuhiro Hashimoto, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 219 days.

(21) Appl. No.: 10/764,531

(22) Filed: Jan. 27, 2004

(65) Prior Publication Data

US 2005/0026062 A1 Feb. 3, 2005

(30) Foreign Application Priority Data

Jul. 29, 2003 (JP) ..... 2003-203040

(51) Int. Cl.
*G03G 9/08* (2006.01)

(52) U.S. Cl. ..... 430/108.5; 430/108.6; 430/110.3

(58) Field of Classification Search ..... 430/108.5, 430/108.6, 110.3
See application file for complete search history.

(56) References Cited

U.S. PATENT DOCUMENTS

| | | | | |
|---|---|---|---|---|
| 4,883,735 | A | 11/1989 | Watanabe et al. | 430/109 |
| 5,766,814 | A * | 6/1998 | Baba et al. | 430/111.32 |
| 6,090,515 | A | 7/2000 | Tomiyama et al. | 430/106 |
| 6,124,070 | A * | 9/2000 | Baba et al. | 430/109.3 |
| 6,146,802 | A | 11/2000 | Okada et al. | 430/110 |
| 6,358,654 | B1 | 3/2002 | Ito et al. | 430/108.1 |
| 6,365,314 | B1 | 4/2002 | Tomiyama et al. | 430/108.23 |
| 6,465,144 | B1 | 10/2002 | Hashimoto et al. | 430/106.1 |
| 2002/0160294 | A1 | 10/2002 | Okuno et al. | 430/124 |
| 2003/0077532 | A1 | 4/2003 | Okada et al. | 430/108.1 |
| 2003/0162116 | A1 | 8/2003 | Katsuta et al. | 430/108.23 |

FOREIGN PATENT DOCUMENTS

| | | |
|---|---|---|
| EP | 0 977 092 A2 | 2/2000 |
| EP | 1 327 914 A2 | 7/2003 |
| JP | 56-13945 | 4/1981 |
| JP | 63-184762 | 7/1988 |
| JP | 07-140701 | 6/1995 |
| JP | 11-258847 | 9/1999 |
| JP | 00-056518 | 2/2000 |
| JP | 01-22118 | 1/2001 |
| JP | 01-343788 | 12/2001 |
| JP | 02-555480 | 2/2002 |
| JP | 02-251037 | 9/2002 |

OTHER PUBLICATIONS

Translation JP-07-140701.

* cited by examiner

*Primary Examiner*—John L Goodrow
(74) *Attorney, Agent, or Firm*—Fitzpatrick, Cella, Harper & Scinto

(57) ABSTRACT

In a non-magnetic toner having non-magnetic toner particles containing at least a binder resin and a colorant, and an inorganic fine powder, the non-magnetic toner particles contain at least one ether compound having a specific structure, and the ether compound is in a content of from 5 ppm to 1,000 ppm.

20 Claims, 6 Drawing Sheets

NON-MAGNETIC TONER

BACKGROUND OF THE INVENTION

1. Field of the Invention

This invention relates to a toner used in recording processes such as electrophotography, electrostatic recording, electrostatic printing and so forth.

2. Related Background Art

A number of methods are conventionally known as methods for electrophotography. In common electrophotography, copies or prints are obtained by forming an electrostatic latent image on an electrostatic latent image bearing member (hereinafter also "photosensitive member") by utilizing a photoconductive material and by various means, subsequently developing the latent image by the use of a toner to form a toner image as a visible image, transferring the toner image to a transfer medium such as paper as occasion calls, and then fixing the toner image to the transfer medium by the action of heat and/or pressure.

As methods for rendering the electrostatic latent image visible by the use of a toner, used are cascade development, magnetic-brush development, pressure development, magnetic-brush development making use of a two-component developer composed of a carrier and a toner, non-contact one-component development in which a toner-carrying member is in non-contact with a photosensitive member and the toner is made to fly from the toner-carrying member to the photosensitive member, contact one-component development in which a toner-carrying member is kept in pressure contact with a photosensitive member and the toner is moved from the former to the latter, and jumping development making use of a magnetic toner.

In recent years, as electrophotographic apparatus such as printers, there is a tendency toward higher resolution as a trend of techniques. More specifically, those which hitherto have a resolution of 300 dpi or 600 dpi are being replaced by those having a resolution of 1,200 dpi or 2,400 dpi. Accordingly, developing systems are now required to achieve a higher minuteness. Copying machines have also made progress to have higher functions, and hence they trend toward digital systems. In processes where images are formed by digital processing, chiefly employed is a method in which electrostatic latent images are formed by using a laser. With such digitization, the copying machines are urged to make progress toward higher resolution, and hence they are also required, like the printers, to form images in higher resolution and higher minuteness.

In addition, in the field of electrophotography, color image formation is on rapid progress. Color images are formed by development performed superimposing yellow, magenta, cyan and black four-color toners appropriately, and hence the respective-color toners are sought to have a higher developing performance than those in monochromatic image formation. More specifically, it is sought to provide toners which can develop electrostatic latent images faithfully, can surely be transferred to transfer mediums without scattering and can be fixed with ease to the transfer mediums such as paper.

Accordingly, it has become important to control charge quantity and charge quantity distribution (hereinafter these are termed as charging performance) of toners as uniformly as possible.

The action of charge control agents and the state of adhesion of external additives, described later are chiefly concerned in the charging performance of toners. Then, as techniques for ascertaining the state of adhesion of external additives, techniques are known in which it is defined as the level of liberated external additives (see, e.g., Japanese Patent Applications Laid-open No. H11-258847 and No. 2001-022118).

In these techniques, the level of liberated external additives is controlled by selecting conditions for the step of external addition and the particle diameter and surface state of external additives.

Meanwhile, a publication is also available which argues that both the state of adhesion of a specific external additive and a specific charge control agent used in toner particles are concerned in the image quality (see, e.g., Japanese Patent Application Laid-open No. 2002-055480).

The above publication, however, does not argue about the fact that a specific compound contributes to the achievement of a uniform and reliable state of adhesion of external additives to toner particles to consequently uniform the charging performance of toner and improve the charging performance of toner. Further, it does not argue about the fact that a specific compound shows an auxiliary charge controllability and also it acts mutually with other charge control agent to improve charging performance.

Charge control agents usually used in order to control the charging performance of toners are roughly grouped into two types, a compound having a complex structure wherein a ligand component has coordinated to the central metal and a polymeric compound containing a polar functional group serving as a charging site. The compound having a complex structure has crystallizability and hence has a poor compatibility with binder resins, so that toner production processes may inevitably be limited when it is intended to disperse the compound uniformly in toner particles. In contrast thereto, the polymeric compound type agent has so high compatibility with binder resins as to be readily uniformly dispersed in toner particles, and hence this may place less restriction to production processes and to selection of materials and so forth used in combination.

As the polymeric compound type charge control agent, a resin containing a polymerizable monomer having a specific structure is proposed (see, e.g., Japanese Patent Application Laid-open No. S63-184762).

Meanwhile, toner images formed on the photosensitive member in the step of development are transferred to a recording medium in the step of transfer. Any transfer residual toner at image areas and fogging toner at non-image areas which have been left on the photosensitive member are removed in the step of cleaning, and is stored in a waste toner container. In respect of this cleaning step, blade cleaning, fur brush cleaning, roller cleaning and so forth are conventionally performed. When viewed from the standpoint of apparatus, the apparatus must be made larger in order to provide such a cleaning means. This has been a bottleneck in attempts to make apparatus compact. In addition, from the viewpoint of ecology, a system that may less produce waste toner is desired. Thus, it is sought to provide a toner having a high transfer efficiency and less causing fog.

The charge quantity and charge quantity distribution of toner and the circularity (or sphericity) of toner are concerned in the transfer efficiency.

The transfer efficiency can be high as long as the charge quantity of toner is in a proper range and its distribution is narrow.

If the toner has a low circularity, i) the area of contact of a toner with a drum is large, and hence ii) toner particle surfaces have large unevenness to tend to cause the concentration of electric charges to edge areas, and make large the image force that is produced correspondingly to such areas, resulting in a low releasability of the toner from the drum. That is, in order to improve the transfer efficiency, the toner must be made to have a high circularity.

To make the toner have a high circularity, how to achieve it may differ depending on toner production processes. Processes for producing toners are roughly grouped into a pulverization process and a polymerization process.

The pulverization process is a process in which a binder resin, a colorant and so forth are melt-kneaded to disperse in the binder resin the components other than that, followed by pulverization by means of a fine grinding mill and then classification by means of a classifier to obtain toner with desired particle diameters. In the toner produced by such a pulverization process, the rupture sections caused by pulverization form toner particle surfaces, and hence the toner particle surfaces stand uneven. Hence, the circularity can not be made sufficiently high by such pulverization alone, and it comes necessary to make toner particles spherical by surface modification treatment such as application of mechanical impact or heat treatment as a post-treatment step.

The polymerization process includes production processes of two types, an association agglomeration process and a suspension polymerization process; the former being a process in which, in an aqueous medium containing resin particles formed by emulsion polymerization, serving as a binder resin component, the resin particles and also a colorant, a release agent and so forth are made to undergo association agglomeration in desired particle diameters, and the latter being a process in which a polymerizable monomer composition prepared by dispersing or dissolving a colorant, a release agent, a polymerization initiator and so forth in a polymerizable monomer serving as a binder resin component is made into droplets with desired particle diameters by shear force in an aqueous medium, followed by suspension polymerization.

In the association agglomeration toner as well, its particle surfaces have unevenness caused by the production process. Hence, in order to enhance its circularity, it requires surface modification treatment by a post-step of, e.g., heating the toner particles obtained after agglomeration, or adding a polymerizable monomer composition anew to carry out seed polymerization. The suspension polymerization toner is obtained by polymerizing a polymerizable monomer present in the monomer composition standing in droplets, and hence its particles have a shape closer to a truely spherical shape and have less uneven surfaces, than those in other production processes. Hence, a toner with a high circularity can be obtained without requiring any post-treatment step (see, e.g., Japanese Patent Application Laid-open No. 2001-343788).

That is, the production by suspension polymerization making use of the polymeric compound type charge control agent makes it possible to obtain a toner which is uniformly chargeable and has high transfer efficiency (see, e.g., Japanese Patent Application Laid-open No. 2000-056518).

A technique is also disclosed in which the residual monomer content in toner particles is reduced by using a polymerization initiator having a specific structure (see, e.g., Japanese Patent Application Laid-open No. 2002-251037). There, however, is no disclosure as to the fact that a polymerization initiator having a specific structure forms a specific ether compound and its presence brings an improvement in image quality.

As discussed above, the planning of shape control of toner particles and material design of charge control agents brings an improvement in the charging performance of toners. The controlling of types of external additives and surface treatment thereof and mutual action between external additives and charge control agents also makes it possible to lower the level of liberated external additives and to reduce any contamination due to liberated external additives on members in which the toners participate (in particular, members participating in the development step and the transfer step). However, the both can not simultaneously be satisfied by mere combination alone of these techniques. That is, in the background art, the charging performance required as toners is not sufficiently good, or the member contamination due to external additives is not taken into consideration. Thus, in improving the charging performance synthetically, there has been room for improvement.

SUMMARY OF THE INVENTION

An object of the present invention is to provide a toner having solved the above problems of the background art.

Another object of the present invention is to improve the state of adhesion of external additive to toner particles to restrain any contamination of surrounding members that is caused by the sticking of external additives thereto.

A still another object of the present invention is to provide a toner having superior charging stability against environment, and being able to give high-quality images over a long period of time.

That is, the present invention provides a non-magnetic toner comprising non-magnetic toner particles containing at least a binder resin and a colorant, and an inorganic fine powder;

the non-magnetic toner particles containing at least one compound of compounds represented by the following structural formulas; the compound (at least one compound) being in a content of from 5 ppm to 1,000 ppm:

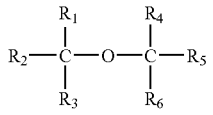

wherein $R_1$ to $R_6$ each represent an alkyl group having 1 to 6 carbon atoms, and may be the same with or different from one another; and

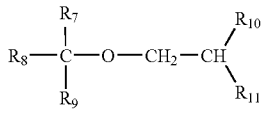

wherein $R_7$ to $R_{11}$ each represent an alkyl group having 1 to 6 carbon atoms, and may be the same with or different from one another.

The toner of the present invention may less cause the contamination of members by the sticking of external additives thereto, also shows good developing performance and high transfer performance without being affected by various environments where the toner is used, and can maintain high image quality over a long period of time.

The same effect is also obtainable in full-color printers.

DETAILED DESCRIPTION OF THE PREFERRED EMBODIMENTS

Figure 1:
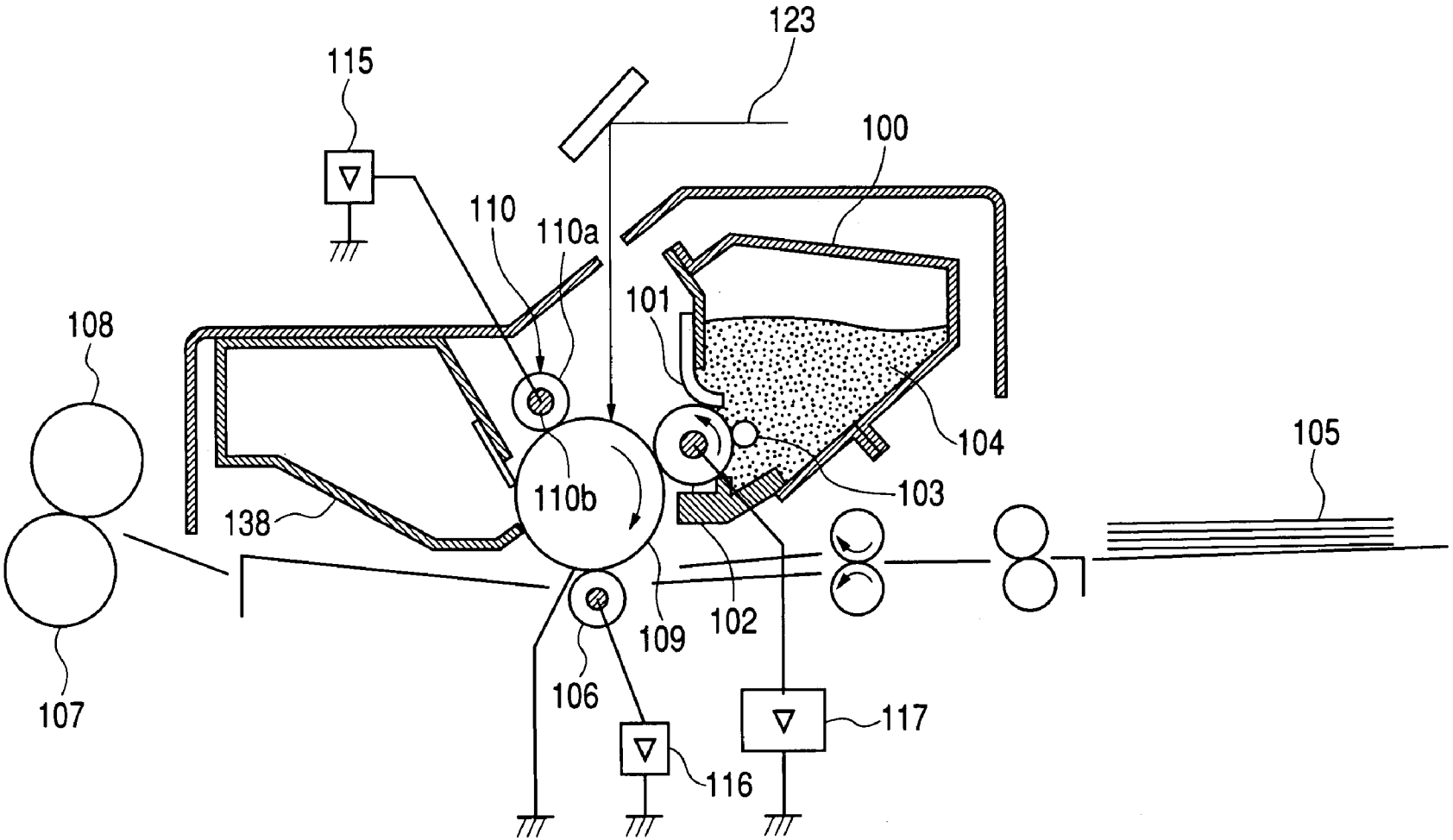
FIG. 1 is a schematic view showing an example of an image-forming apparatus to which the toner of the present invention is applicable.

As a result of extensive studies, the present inventors have attained a non-magnetic toner that may less cause the contamination of members by the sticking of external additives thereto, also shows good developing performance and high transfer performance without being affected by various environments where the toner is used, and can maintain high image quality over a long period of time. This has been attained by incorporating in non-magnetic toner particles at least one compound of compounds represented by the following structural formulas, whereby the state of adhesion of external additives is improved, and also has been attained in virtue of the effect of uniforming charge quantity distribution, the effect the compounds represented by the following structural formulas have.

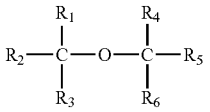

wherein $R_1$ to $R_6$ each represent an alkyl group having 1 to 6 carbon atoms, and may be the same with or different from one another.

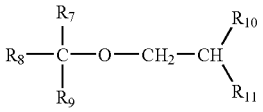

wherein $R_7$ to $R_{11}$ each represent an alkyl group having 1 to 6 carbon atoms, and may be the same with or different from one another.

The present invention is described below in detail.

The compounds essential for the present invention are each an ether compound having a structure represented by the above chemical formulas. The reason is unclear why the object of the present invention can be achieved by the incorporation of this ether compound. The present inventors presume it as follows:

The ether compound has good compatibility with binder resins, and hence, when incorporated in toner particles, the ether compound is considered to be present being dispersed in an almost uniform state. Also, the oxygen atom is an element having a high electronegativity, and hence it makes negative electric charges non-localized which have been produced in the toner. The ether compound has these two characteristic features. Hence, the presence of the ether compound stabilizes the negative electric charges. Thus, the effect brought by the incorporation of the ether compound is remarkable especially when the toner of the present invention is a negatively chargeable toner. On the other hand, the non-shared electron pair acts mutually with positive electric charges, and hence the ether compound is considered to show a stabilization effect to a certain extent on the positive electric charges as well.

The ether compound has a tertiary carbon atom, and has a bulky structure. The functional groups around the tertiary carbon atom function as a steric hindrance factor, and hence the toner can not easily be affected by the water that is a main factor of the emission of electric charges, so that the electric charges are kept from leaking. Since, however, the carbon atom bonded to the oxygen atom makes a rotary motion, the functional groups that may cause steric hindrance can also move, and, since water molecules participating in the leak of charging are small molecules, do not cause any complete steric hindrance. As the result, the functional groups around the tertiary carbon atom are considered to function as an appropriate steric hindrance factor. The ether compound is also known to form coordinate bonds between it and water molecules. Since, however, the hydrophilicity and hydrophobicity of the ether compound are appropriately balanced, the water molecules that coordinate are in a quantity suited for the control of charge-up of the toner. As the result, it is considered that the ether compound, when viewed as a whole, has the function to hold to a certain extent the electric charges it has received, and also to emit them gradually at a gentle rate, having the function both to play a role as a buffer of electric charges and to control the charge-up.

Incidentally, in magnetic toners, the effect of the present invention may be obtained with difficulty even if the ether compound is present. As a reason therefor, the present inventors consider that a magnetic material in the toner has the function to play a role as a buffer of electric charges and to control the charge-up.

Usually, external additive are also mixed in toners. As at least one external additive among them, one having the same polarity as the chargeability of toner particles is often used. In the step of external addition, the particles come charged electrostatically with high-speed rotation, because of friction between toner particles themselves, between toner particles and external additives, between toner particles and an apparatus for external addition and between external additives and the apparatus for external addition. In that course as well, the ether compound functions as described above, and leaks any excess electric charges to make the toner particles have appropriate electric charges, and hence the electrostatic repulsion acting between toner particles and external additives is reduced, so that the adhesion of external additives to toner particles can more be in an almost uniform state, as so considered. Moreover, this function is efficiently brought out when the toner particles and the external additives have the same charge polarity. This is because, where the toner particles and the external additives have different charge polarities, they tend to attract each other electrostatically and hence the intended effect can be brought out with difficulty. Incidentally, the fact that the toner particles and the external additives have the same charge polarity is defined by the charge polarity in their blending with an iron powder carrier.

If in the above formulas at least one of any of $R_1$ to $R_{11}$ is a hydrogen atom, the effect as steric hindrance may vastly lessen. If on the other hand the alkyl group is one having 7 or more carbon atoms, the balance between hydrophobicity and hydrophilicity may greatly change and the compatibility with the binder resin may lower to make the effect of the present invention not obtainable.

The alkyl groups represented by $R_1$ to $R_{11}$ may particularly preferably be those having 1 to 4 carbon atoms.

In order to bring out the above effect sufficiently, the ether compound must be contained in the toner particles in an amount within the range of from 5 ppm to 1,000 ppm. If the ether compound in the toner particles is in a content of less than 5 ppm, the above effect may come not obtainable. If it is in a content of more than 1,000 ppm, a broad charge quantity distribution tends to result. It may also more preferably be in a content of from 10 ppm to 800 ppm, and still more preferably from 10 ppm to 500 ppm.

As examples of the structure of the ether compound, it may include the following structures.

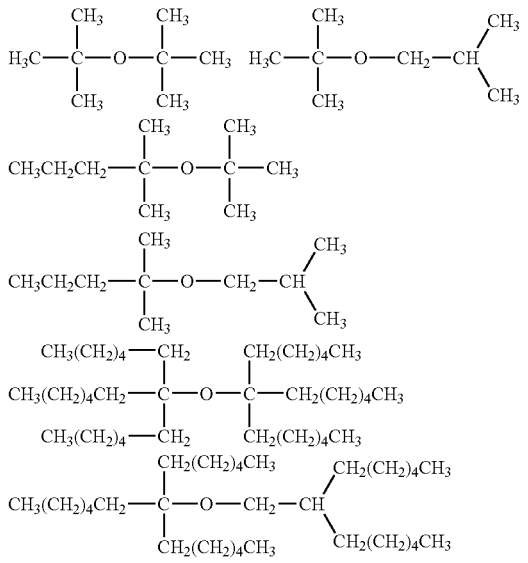

Of these, compounds represented by the following structural formulas are preferred in order to obtain the effect of the present invention.

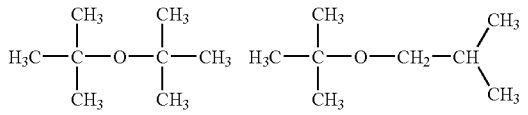

As the ether compound, at least one compound may be contained, and the ether compound(s) having different structure(s) may also be contained together. In the latter case, the content is expressed as the total sum of the quantities of the ether compounds contained.

The quantitative determination of the ether compound may be made by, e.g., a gas chromatograph equipped with an FID (flame ionization detector) or a mass spectrometer as a detector, or a liquid chromatograph equipped with a UV spectrometer or a differential refractometer.

In the present invention, the quantity of the ether compound contained in toner particles is measured by multiple head space extraction making use of a head space sampler, to make evaluation.

Apparatus and Instrument

As the head space sampler, HS40XL, manufactured by K.K. Perkin-Elmer Japan, is used. GC-MS (gas chromatography mass spectrometry) is carried out using TRACE GC or TRACE MS, manufactured by Thermoquest K.K.

The peak area according to the multiple head space extraction is calculated using the following approximate expression:

$$\Sigma A_n = A^2 1/(A_1 - A_2)$$

where $\Sigma A_n$ is the total peak area, and $A_n$ is the peak area at the n-th time extraction.

A sample vial is connected to a gas chromatograph, and analysis is made by the multiple head space extraction.

(1) Conditions for Head Space Sampler
Sample quantity: 50 mg
Vial: 22 ml
Sample temperature: 120° C.
Needle temperature: 150° C.
Transfer line temperature: 180° C.
Retention time: 60 minutes
Pressure time: 0.25 minute
Injection time: 0.08 minute (2) GC Conditions
Column: HP5-MS (0.25 mm, 60 m)
Column temperature: 40° C. (3 min.), 70° C. (2.0° C./min.), 150° C. (5.0° C./min.), 300° C. (10.0° C./min.)
Split ratio: 50:1

(3) Instrument

As a sealed vessel, a glass vial (22 ml) for head space analysis, manufactured by K.K. Perkin-Elmer Japan, is used.

(4) How to Measure

1) Preparation of Standard Sample:

First, a methanol solution with an ether compound concentration of 1,000 ppm is prepared as a standard sample for the ether compound quantitative determination. A portion of 5 μl of this solution is put into the 22 ml glass vial, using a microsyringe of 10 μl in volume, which is quickly sealed with a septum for high-temperature analysis.

Where the structure of the ether compound is unknown, the structure may be specified by an analytical method such as gas chromatography mass spectrometry (GC-MS) or liquid chromatography mass spectrometry (LC-MS), and the quantitative determination may be made by the above method using the substance specified. 2) Preparation of toner sample:

50 mg of the toner is put into the 22 ml glass vial, which is then sealed with a septum for high-temperature analysis to made up a sample.

(5) Analysis

First, the standard sample of the ether compound is measured using the quantitative multiple head space extraction to determine the total peak area per 0.005 μl of the ether compound (incidentally, since the sensitivity of GC may vary day by day, the peak area per 0.005 μl of the ether compound must beforehand be examined for each measurement).

Next, the volume of the ether compound in the measuring sample is found by proportional calculation from the total peak area of the toner determined by the quantitative multiple head space extraction and the total peak area of the ether compound standard sample. The value found by calculation is multiplied by the specific gravity of the ether compound to make conversion into weight, and the concentration of the ether compound in toner particles is calculated.

Average circularity the toner of the present invention may have in a preferred embodiment is described below.

The toner of the present invention may preferably have an average circularity of from 0.940 to 0.995. Toner particles having an average circularity of 0.940 or more have a good transfer performance. This is because the area of contact of the toner particles with the photosensitive member is so small as to lower the force of attraction of the toner particles to the photosensitive member, coming from image force or van der Waals force. Hence, the use of such a toner promises a high transfer efficiency, and contributes to the reduction of toner consumption.

In addition, the toner having an average circularity of 0.940 or more has less edges on their surfaces, and hence the localization of electric charges within each particle may take place with difficulty. Hence, the charge quantity distribution also tends to be narrow, and development faithful to latent images can be performed. An average circularity of 0.960 or more is preferred. However, even when the toner has a high average circularity, the effect may be insufficient when the particles present there have a low circularity. Accordingly, in order to obtain the above effect, the toner of the present invention may particularly preferably have a circularity of 0.99 or more as mode circularity described later.

On the other hand, a toner constituted of toner particles having an average circularity of more than 0.995 has a very high circularity, and hence makes it difficult to obtain the effect of controlling faulty cleaning, which is an effect of the present invention.

The average circularity referred to in the present invention is used as a simple method for expressing the shape of particles quantitatively. In the present invention, the shape of particles is measured with a flow type particle image analyzer FPIA-1000, manufactured by Toa Iyou Denshi K.K., and circularity (ai) of individual particles measured on a group of particles having a circle-corresponding diameter of 3 μm or larger is found according to the following Equation (1). As also further shown in the following Equation (2), the value obtained when the sum total of circularity of all particles measured is divided by the number (m) of all particles is defined to be the average circularity (a).

$$\text{Circularity}(ai) = \frac{\text{Circumferential length of a circle with the same projected area as particle image}}{\text{Circumferential length of particle projected image}} \quad \text{Equation (1)}$$

$$\text{Average circularity } (a) = \sum_{i=1}^{m} ai/m \quad \text{Equation (2)}$$

The mode circularity refers to a peak circularity at which the value of frequency in circularity frequency distribution comes maximum when circularities are divided into 61 ranges at intervals of 0.01 as from 0.40 to 1.00 and the circularity of particles thus measured is assigned to each divided range.

The measuring device "FPIA-1000" used in the present invention employs a calculation method in which, in calculating the circularity of each particle and thereafter calculating the average circularity and mode circularity, the circularities of from 0.40 to 1.00 are divided into classes divided into 61 ranges, in accordance with the resultant circularities, and the average circularity and mode circularity are calculated using the center values and frequencies of divided points. Between the values of the average circularity calculated by this calculation method and the values of the average circularity calculated by the above calculation equation which uses the circularity of each particle directly, however, there is only a very small accidental error, which is at a level that is substantially negligible. Accordingly, in the present invention, such a calculation method in which the concept of the calculation equation which uses the circularity of each particle directly is utilized and its calculation method is partly modified may be used, for the reasons of handling data, e.g., making the calculation time short and making the operational equation for calculation simple.

The measurement is made in the following way. In 10 ml of water in which about 0.1 mg of a surface-active agent has been dissolved, 5 mg of the toner is dispersed to prepare a dispersion. Then the dispersion is exposed to ultrasonic waves (20 kHz, 50 W) for 5 minutes and the dispersion is made to have a concentration of 5,000 to 20,000 particles/μl, where the measurement is made using the above analyzer to determine the average circularity and mode circularity of the group of particles having a circle-corresponding diameter of 3 μm or more.

The average circularity referred to in the present invention is an index showing the degree of surface unevenness of toner. It is indicated as 1.000 when the toner particles are perfectly spherical. The more complicate the surface shape is, the smaller the value of circularity is.

In the above measurement, the reason why the circularity is measured only on the group of particles having a circle-corresponding diameter of 3 μm or more is that a group of particles of external additives that is present independently from toner particles are included in a large number in a group of particles having a circle-corresponding diameter of less than 3 μm. Hence, if particles to be measured are extended to those of less than 3 μm, they may affect the measurement not to enable any accurate estimation of the circularity on toner particles.

The particle diameter of the toner is described below.

The toner of the present invention may preferably have a weight-average particle diameter of from 3 to 10 μm in order to develop minuter latent image dots for achieving much higher image quality. The toner may more preferably have a weight-average particle diameter of from 4 to 8 μm.

In a toner having a weight-average particle diameter of less than 3 μm, the transfer residual toner may remain on the photosensitive member in a large quantity because of a lowering of transfer efficiency. In such a case, it may become difficult to prevent abrasion of, or melt-adhesion of toner to, the photosensitive member in the step of contact charging. Moreover, the toner may have a large surface area on the whole and, in addition thereto, it may have a low fluidity and agitatability required as a powder to make it difficult for individual toner particles to be uniformly charged. This tends to make fogging serious or make transfer performance poor, and tends to cause not only abrasion and melt-adhesion but also non-uniformity of images. Thus, such a toner is undesirable for the toner of the present invention. Also, in the case of a toner having a weight-average particle diameter of more than 10 μm, spots around line images tend to occur in character and line images, making it difficult to attain a high resolution.

In order to attain much higher resolution, it is preferable to use a toner having a weight-average particle diameter of 8 μm or less.

In order to more efficiently bring out the effect of the toner of the present invention, it is more preferable for the toner of the present invention to have the average circularity of from 0.940 to 0.995 and in addition have the weight-average particle diameter (D4) of from 3 to 10 μm. It is particularly preferable that the toner further has the mode circularity of 0.99 or more, because particles having uniform circularity can be present in a large number and hence the charging performance is improved.

The weight-average particle diameter and number-average particle diameter of the toner of the present invention may be measured with Coulter Counter Model TA-II or Coulter Multisizer (manufactured by Coulter Electronics, Inc.). Stated specifically, they may be measured in the following way: Coulter Multisizer (manufactured by Coulter Electronics, Inc.) is used. An interface (manufactured by Nikkaki k.k.) that outputs number distribution and volume distribution and a personal computer PC9801 (manufactured by NEC.) are connected. As an electrolytic solution, an aqueous 1% NaCl solution is prepared using first-grade sodium chloride. For example, ISOTON R-II (available from Coulter Scientific Japan Co.) may be used. Procedure of measurement is as follows:

From 100 to 150 ml of the above aqueous electrolytic solution is added, and from 2 to 20 mg of a sample to be measured is further added. The electrolytic solution in which the sample has been suspended is subjected to dispersion for about 1 minute to about 3 minutes in an ultrasonic dispersion machine. The volume distribution and number distribution are calculated by measuring the volume and number of toner particles with particle diameters of 2 μm or more by means of the above Coulter Multisizer, using an aperture of 100 μm as its aperture. From the values obtained, the weight-average particle diameter (D4) and the number-average particle diameter (D1) are determined.

The toner of the present invention may be produced by pulverization. However, the toner particles obtained by such pulverization commonly have an amorphous shape, and hence any mechanical or thermal treatment or any other treatment must be made in order to attain the physical properties that the average circularity be from 0.940 to 0.995, and preferably the mode circularity be 0.99 or more, which are preferable requirements for the toner according to the present invention.

Accordingly, in the present invention, the toner particles may preferably be produced by polymerization. Methods for producing toner particles by polymerization may include direct polymerization, suspension polymerization, emulsion polymerization, emulsion association polymerization and seed polymerization. Of these, in view of the readiness to balance particle diameter and particle shape, it is particularly preferable to produce toner particles by suspension polymerization. In this suspension polymerization, a colorant and also optionally a polymerization initiator, a cross-linking agent, a charge control agent and other additives are uniformly dissolved or dispersed in a polymerizable monomer to form a polymerizable monomer composition, and thereafter this polymerizable monomer composition is dispersed in a continuous phase (e.g., an aqueous phase) containing a dispersion stabilizer, by means of a suitable stirrer to carry out polymerization reaction to obtain toner particles having the desired particle diameters. In the case when the toner particles are produced by this suspension polymerization, the individual toner particles stand uniform in substantially a spherical shape, and hence the toner which satisfies the requirements that the average circularity be from 0.940 to 0.995 and particularly the mode circularity be 0.99 or more can be obtained with ease. Moreover, such a toner can also have a relatively uniform charge quantity distribution, and hence has a high transfer performance.

A polymerizable monomer and a polymerization initiator may further again be added to the fine particles obtained by suspension polymerization to provide surface layers to obtain toner particles having a core/shell structure. Such a toner may also be designed as occasion calls.

In the present invention, it is also a preferred embodiment that a charge control agent is used in combination in order to enhance the effect of the ether compound and stabilize charge characteristics. In particular, a case in which a "resin having sulfur atoms" (herein also "polar polymer") is used as the charge control agent is particularly preferred because the mutual action between the ether compound and the resin having sulfur atoms can well be balanced.

In order to more enhance the effect of stabilizing electric charges the ether compound has, what is important is its mutual action with the charge control agent. The resin having sulfur atoms has a smaller chemical structure at charging sites than complex type charge control agents, and hence it can readily mutually act with the ether compound. As the result, the function of the ether compound can especially effectively be brought out when the ether compound and the resin having sulfur atoms are used in combination. The present inventors consider so.

The "resin having sulfur atoms" in the present invention refers to a resin having, in molecular weight in terms of polystyrene as measured by gel permeation chromatography described later, a peak top in the range of 1,000 or more and containing a sulfur element. Further, the resin having sulfur atoms may preferably have a weight-average molecular weight (Mw) of from 2,000 to 100,000. If it has a weight-average molecular weight (Mw) of less than 2,000, the toner may have a poor fluidity, resulting in a low transfer performance. If it has a weight-average molecular weight (Mw) of more than 100,000, it takes the resin a time to be dissolved in monomers and, in addition thereto, pigments may come poorly dispersible, resulting in a low coloring power of the toner.

In order that the resin having sulfur atoms brings out charging performance in the toner, the sulfur element may preferably be one having specific valency and state of bond, and a sulfur element is used which has a peak top at a bond energy of from 160 to 172 eV that is present at toner particle surfaces, measured by X-ray photoelectric spectrophotometry described later. In particular, tetravalent or hexavalent one is preferred, and hexavalent one is particularly preferred. As a state in which the sulfur element is contained, preferred is a resin in which it is contained as a functional group such as sulfonic acid, a sulfonate (salt), a sulfuric ester or a sulfuric ester salt, and more preferred is a resin in which it is contained as a functional group such as sulfonic acid or a sulfonate (salt).

In the toner of the present invention, in the case when the resin having sulfur atoms is incorporated, in order to bring out its effect to the maximum, it is advantageous to make this resin present at particle surface portions that are most concerned in the charging of the toner.

In the toner of the present invention, the ratio of content (E: atomic % by number) of sulfur atoms present at toner particle surface portions to content (A: atomic % by number) of carbon atoms present at toner particle surface portions, E/A, as measured by X-ray photoelectric spectrophotometry may preferably be within the range of from 0.0003 to 0.0050. This ratio can be controlled within the preferable range by controlling the amount of sulfur atoms to be contained in the binder resin and the amount of the resin having sulfur atoms to be used. If the ratio is less than 0.0003, sufficient charge quantity may be attained with difficulty. If it is more than 0.0050, the stability of charge quantity to moisture changes tends to lower.

The ratio of the content (E) of sulfur atoms present at toner particle surface portions to the content (A) of carbon atoms present there, E/A, may be measured by analyzing surface composition by ESCA (X-ray photoelectric spectrophotometry) in the following way.

In the present invention, the instrument and measuring conditions of the ESCA are as follows:

Instrument used: 1600S type X-ray photoelectric spectrophotometer, manufactured by PHI Co.

Measuring conditions: X-ray source, MgKα (400 W).

Spectral range: 800 μmØ.

In calculating surface atom concentration, used is the intensity of a peak top present at a bond energy of from 160 to 172 eV in regard to sulfur atoms, and that at a bond energy of from 280 to 290 eV in regard to carbon atoms.

In the present invention, the surface atom concentration is calculated from the peak intensity of each element measured, using relative sensitivity factors provided by PHI Co.

In this measurement, measurement may preferably be made after the toner has been subjected to ultrasonic cleaning and external additives adhering to toner particle surfaces have been removed by a method such as decantation, filtration or centrifugation followed by drying.

As a sulfur-containing monomer for producing the resin having sulfur atoms according to the present invention, it may include styrene sulfonic acid, 2-acrylamido-2-methylpropanesulfonic acid, 2-methacrylamido-2-methylpropanesulfonic acid, vinylsulfonic acid and methacrylsulfonic acid, or a maleic acid amide derivative, a maleimide derivative and a styrene derivative which have the following structures, respectively.

Maleic Acid Amide Derivative:

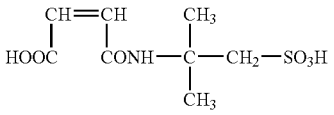

Maleimide Derivative:

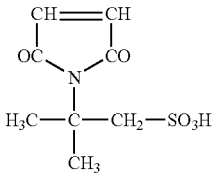

Styrene Derivative:

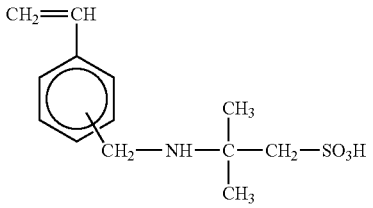

(bonded at the ortho-position or the para-position)

The resin having sulfur atoms according to the present invention may be a homopolymer of any of the above monomers, or may be a copolymer of any of the above monomers with other monomer. The monomer which forms such a copolymer together with any of the above monomers may include vinyl type polymerizable monomers. Usable are monofunctional polymerizable monomers and polyfunctional polymerizable monomers.

Of the above monomers, in order to achieve charging performance preferable for the toner of the present invention, monomers having sulfonic acid are preferred, and sulfonic-acid-group-containing acryl- or methacrylamide is more preferred.

The sulfur-containing monomer used in producing by polymerization the resin having sulfur atoms according to the present invention may preferably be in an amount within the range of from 0.01 to 20% by weight in order to achieve preferable charge quantity in the toner. For the same reason, it may more preferably be in an amount within the range of from 0.05 to 10% by weight, and still more preferably within the range of from 0.1 to 5% by weight.

The monofunctional polymerizable monomers may include styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene; acrylate type polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate and 2-benzoyloxyethyl acrylate; methacrylate type polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate and dibutyl phosphate ethyl methacrylate; methylene aliphatic monocarboxylates; vinyl esters such as vinyl acetate, vinyl propionate, vinyl butyrate, vinyl benzoate and vinyl formate; vinyl ethers such as methyl vinyl ether, ethyl vinyl ether and isobutyl vinyl ether; and vinyl ketones such as methyl vinyl ketone, hexyl vinyl ketone and isopropyl vinyl ketone.

The polyfunctional polymerizable monomers may include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis[4-(acryloxy.diethoxy)phenyl]propane, trimethyrolpropane triacrylate, tetramethyrolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis[4-(methacryloxy.diethoxy)phenyl]propane, 2,2'-bis[4-(methacryloxy.polyethoxy)phenyl]propane, trimethyrolpropane trimethacrylate, tetramethyrolmethane tetramethacrylate, divinyl benzene, divinyl naphthalene, and divinyl ether.

In the resin having sulfur atoms, any of the monomers as descirbed above may be used as the monomer that may be used in combination with the monomer having a sulfur atom (the sulfur-containing monomer). It is more preferable for this resin to contain styrene or a styrene derivative as the monomer.

The resin having sulfur atoms may be produced by a process including bulk polymerization, solution polymerization, emulsion polymerization, suspension polymerization and ionic polymerization. In view of operability and so forth, solution polymerization is preferred.

The resin having sulfur atoms may be exemplified by a polymer having sulfonic acid groups which has the following structure.

$$X(SO_3^-)n \cdot mY^{k+}$$

wherein X represents a polymer moiety derived from the above polymerizable monomer, $Y^{k+}$ represents a counter ion, k is the valence number of the counter ion, m and n are each an integer, where n is k×m.

In this case, the counter ion may preferably be a hydrogen ion, a sodium ion, a potassium ion, a calcium ion or an ammonium ion.

The resin having sulfur atoms may preferably have an acid value (mg·KOH/g) of from 3 to 50, more preferably from 5 to 40, and still more preferably from 10 to 30.

If it has an acid value of less than 3, sufficient charge control action may be attained with difficulty, and also the toner may have poor environmental properties. If it has an acid value of more than 50, in producing toner particles by suspension polymerization using a composition containing such a polymer, the toner particles may come to have a distorted shape, resulting in a small circularity, so that the release agent contained may come to toner particle surfaces, resulting in a low developing performance.

The resin having sulfur atoms may be contained in an amount of from 0.05 to 20 parts by weight, preferably from 0.1 to 10 parts by weight, based on 100 parts by weight of the binder resin.

If the resin having sulfur atoms is in a content of less than 0.05 part by weight, sufficient charge control action may be attained with difficulty. If it is in a content of more than 20 parts by weight, the toner may have a low average circularity to cause a lowering of developing performance and transfer performance.

The content of the resin having sulfur atoms in the toner may be measured by capillary electrophoresis or the like.

The resin having sulfur atoms may preferably have a glass transition point (Tg) of from 50° C. to 100° C. If it has a glass transition point of less than 50° C., the toner may have poor fluidity and storage stability and also may have a poor transfer performance. If it has a glass transition point of more than 100° C., the toner may have poor fixing performance when images with a large toner print percentage.

The resin having sulfur atoms may preferably have a volatile matter of from 0.01% to 2.0%. Making it have a volatile matter of less than 0.01% requires a complicate step of removing the volatile matter. If it has a volatile matter of more than 2.0%, the toner tends to be low charged in a high-temperature high-humidity environment, in particular, tends to be low charged after leaving. The volatile matter of the resin having sulfur atoms corresponds to the proportion of loss in weight on heating for 1 hour at high temperature (135° C.).

When the resin having sulfur atoms is extracted from the toner in measuring the molecular weight and glass transition point of that resin, there are no particular limitations on how to extract the same, and it may be done by any desired method.

In the toner of the present invention, any other known agent than the resin having sulfur atoms may also be used as the charge control agent. In particular, charge control agents which have a high charging speed and also can maintain a constant charge quantity stably are preferred. In the case when the toner particles are directly produced by polymerization, it is preferable to use charge control agents having a low polymerization inhibitory action and free of any solubilizate to the aqueous dispersion medium. However, in the toner of the present invention, the addition of the charge control agent is not essential. The triboelectric charging of toner with a toner layer thickness control member or with the toner-carrying member may intentionally be utilized.

The toner of the present invention may preferably contain a release agent in an amount of from 0.5 to 50 parts by weight based on 100 parts by weight of the binder resin in order to obtain good fixed images. The release agent may be exemplified by waxes of various types.

The release agent usable in the toner according to the present invention may include petroleum waxes and derivatives thereof such as paraffin wax, microcrystalline wax and petrolatum; montan wax and derivatives thereof; hydrocarbon waxes obtained by Fischer-Tropsch synthesis, and derivatives thereof; polyolefin waxes typified by polyethylene wax, and derivatives thereof; and naturally occurring waxes such as carnauba wax and candelilla wax, and derivatives thereof. The derivatives include oxides, block copolymers with vinyl monomers, and graft modified products. Also usable are higher aliphatic alcohols, fatty acids such as stearic acid and palmitic acid, or compounds thereof, acid amide waxes, ester waxes, ketones, hardened caster oil and derivatives thereof, vegetable waxes, and animal waxes. Of these waxes, those having a maximum endothermic peak at 40° C. to 110° C. as measured by differential thermal analysis are preferred, and further those having that of from 45° C. to 90° C. are more preferred.

In the case when the release agent is used, it may preferably be in a content within the range of from 0.5 to 50 parts by weight based on 100 parts by weight of the binder resin. If it is in a content of less than 0.5 part by weight, the toner may have a poor low-temperature anti-offset effect. It it is in a content of more than 50 parts by weight, the toner may have a low long-term storage stability, and also other toner materials may come poorly dispersible, leading to a lowering of fluidity of toner and a lowering of image characteristics.

The maximum endothermic peak temperature of the release agent is measured according to ASTM D3418-8. For the measurement, for example, DSC-7 is used, which is manufactured by Perkin-Elmer Corporation. The temperature at the detecting portion of the device is corrected on the basis of melting points of indium and zinc, and the amount of heat is corrected on the basis of heat of fusion of indium. The sample is put in a pan made of aluminum and an empty pan is set as a control, to make measurement at a heating rate of 10° C./min.

The glass transition temperature (Tg) of the resin having sulfur atoms is determined from a DSC curve at second-time heating, where the temperature at the point at which the middle line between the base line before appearance of the endothermic peak and the base line after appearance of the endothermic peak intersects at the rising curve is regarded as Tg.

The toner of the present invention contains a colorant as an essential component in order to afford coloring power. As organic pigments or organic dyes preferably used in the present invention, they may include the following.

As organic pigments or organic dyes usable as cyan colorants, copper phthalocyanine compounds and derivatives thereof, anthraquinone compounds, basic dye lake compounds and so forth may be used. Stated specifically, they may include C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62 and C.I. Pigment Blue 66.

As organic pigments or organic dyes usable as magenta colorants, condensation azo compounds, diketopyrrolopyrrole compounds, anthraquinone compounds, quinacridone compounds, basic dye lake compounds, naphthol compounds, benzimidazolone compounds, thioindigo compounds and perylene compounds are used. Stated specifically, they may include C.I. Pigment Red 2, C.I. Pigment Red 3, C.I. Pigment Red 5, C.I. Pigment Red 6, C.I. Pigment Red 7, C.I. Pigment Red 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 150, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221 and C.I. Pigment Red 254.

As organic pigments or organic dyes usable as yellow colorants, compounds typified by condensation azo compounds, isoindolinone compounds, anthraquinone compounds, azo metal complexes, methine compounds and allylamide compounds are used. Stated specifically, they may include C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191 and C.I. Pigment Yellow 194.

Any of these colorants may be used alone, in the form of a mixture, or in the state of a solid solution. The colorants used in the present invention are selected taking account of hue angle, chroma, brightness, light-fastness, transparency on OHP films and dispersibility in toner particles.

The colorant may be used in its addition in an amount of from 1 to 20 parts by weight based on 100 parts by weight of the binder resin.

As black colorants, carbon black and colorants toned in black by the use of yellow, magenta and cyan colorants shown above are used.

In the case when the toner is obtained by polymerization, attention must be paid to polymerization inhibitory action or aqueous-phase transfer properties inherent in the colorants. The colorant may more preferably be beforehand subjected to surface modification, e.g., hydrophobic treatment with a material free from polymerization inhibition. In particular, most dye type colorants and carbon black have the polymerization inhibitory action and hence care must be taken when used. A preferable method for the surface treatment of the dye type colorants may include a method in which the polymerizable monomer is beforehand polymerized in the presence of any of these dyes. The resulting colored polymer may be added to the monomer composition.

With regard to the carbon black, besides the same treatment as that on the dye type colorants, it may be treated with a material capable of reacting with surface functional groups of the carbon black, as exemplified by polyorganosiloxane.

A process for producing the toner of the present invention by suspension polymerization is described below.

In the case when the toner of the present invention is produced by suspension polymerization, the polymerizable monomer constituting the polymerizable monomer composition may include the following.

The polymerizable monomer may include styrene; styrene monomers such as o-methylstyrene, m-methylstyrene, p-methylstyrene, p-methoxystyrene and p-ethylstyrene; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and other monomers such as acrylonitrile, methacrylonitrile and acrylamides.

Any of these monomers may be used alone or in combination. Of the foregoing polymerizable monomers, styrene or a styrene derivative may preferably be used alone or in combination with other polymerizable monomer, in view of developing performance and running performance of the toner.

In the production of the suspension polymerization toner according to the present invention, the polymerization may be carried out by adding a resin in the polymerizable monomer composition.

A monomer containing a hydrophilic functional group such as an amino group, a carboxylic group, a hydroxyl group, a glycidyl group or a nitrile group can not be used as the polymerizable monomer because it dissolves in an aqueous suspension to cause emulsion polymerization. When such a monomer component containing a hydrophilic functional group should be introduced into toner particles, it may be used in the form of a copolymer such as a random copolymer, block copolymer or graft copolymer of any of these with a vinyl compound such as styrene or ethylene, in the form of a polycondensation product such as polyester or polyamide, or in the form of a polyaddition polymer such as polyether or polyimine. Where a resin containing such a hydrophilic functional group is made present together in the toner particles, the wax component (release agent) described previously can be phase-separated, and can more firmly be enclosed in particles, so that a toner having good anti-offset properties, anti-blocking properties and low-temperature fixing performance can be obtained.

For the purpose of improving dispersibility of materials, fixing performance or image characteristics, a resin other than the foregoing may also be added to the polymerizable monomer composition. Resins usable therefor may include, e.g., homopolymers of styrene or derivatives thereof, such as polystyrene and polyvinyl toluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; and polymethyl methacrylate, polybutyl methacrylate, polyvinyl acetate, polyethylene, polypropylene, polyvinyl butyral, silicone resins, polyester resins, polyamide resins, epoxy resins, polyacrylic acid resins, rosins, modified rosins, terpene resins, phenolic resins, aliphatic or alicyclic hydrocarbon resins, and aromatic petroleum resins, any of which may be used alone or in the form of a mixture.

In particular, a polyester resin is preferred as the resin used in its addition to the polymerizable monomer composition.

As the polyester resin used in the present invention, any one or both of a saturated polyester resin and an unsaturated polyester resin may be used under appropriate selection in order to control performances such as charging performance, running performance and fixing performance for example, of the toner obtained from toner particles.

An alcohol component and an acid component which constitute the polyester resin used in the present invention are exemplified below.

As the alcohol component, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexane dimethanol, butenediol, octenediol, cyclohexene dimethanol, hydrogenated bisphenol A, a bisphenol derivative represented by the following general formula:

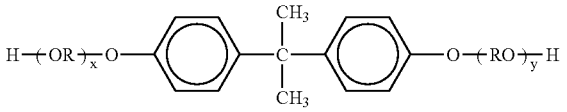

wherein R represents an ethylene group or a propylene group, x and y are each an integer of 1 or more, and an average value of x+y is 2 to 10;

or a hydrogenated product of the compound of the above general formula, and a diol represented by the following general formula:

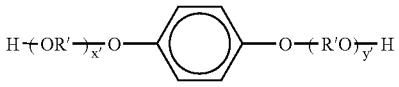

wherein R' represents

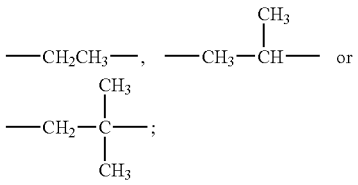

x' and y' are each an integer of 0 or more; and an average value of x'+y' is 0 to 10;

or a diol of a hydrogenated product of the compound of the above formula; further including polyhydric alcohols such as glycerol, pentaerythritol, sorbitol, sorbitan and oxyalkylene ethers of novolak phenol resins.

As a dibasic carboxylic acid, it may include benzene dicarboxylic acids or anhydrides thereof, such as phthalic acid, terephthalic acid, isophthalic acid and phthalic anhydride; alkyldicarboxylic acids such as succinic acid, adipic acid, sebacic acid and azelaic acid, or anhydrides thereof; and further succinic acid or its anhydride, substituted with an alkyl group or alkenyl group having 6 to 18 carbon atoms; unsaturated dicarboxylic acids such as fumaric acid, maleic acid, citraconic acid and itaconic acid, or anhydrides thereof; as well as polycarboxylic acids such as trimellitic acid, pyromellitic acid, 1,2,3,4-butanetetracarboxylic acid, benzophenonetetracarboxylic acid, and anhydrides of these.

The polyester resin may preferably have an acid value of from 0.1 to 50 mg·KOH/1 g of resin, in order for the resultant toner particles to exhibit a stable charging performance. If it has an acid value of less than 0.1 mg·KOH/1 g of resin, it may be present at the toner particle surfaces in an absolutely insufficient quantity. If it has an acid value of more than 50 mg·KOH/1 g of resin, it tends to adversely affect the charging performance of toner particles. In the present invention, it may more preferably have the acid value in the range of from 5 to 35 mg·KOH/1 g of resin.

Such a resin may preferably be added in an amount of from 1 to 20 parts by weight based on 100 parts by weight of the polymerizable monomer. Its addition in an amount of less than 1 part by weight may be low effective. On the other hand, its addition in an amount of more than 20 part by weight tends to make it difficult to design various physical properties of the suspension polymerization toner.

A polymer having a molecular weight different from the range of molecular weight of the binder resin obtained by polymerizing the polymerizable monomer may further be dissolved to carry out polymerization. This enables production of a toner having a broad molecular weight distribution and high anti-offset properties.

As the polymerization initiator used in the production of the suspension polymerization toner of the present invention, a polymerization initiator having a half-life of from 0.5 to 30 hours at reaction temperature at the time of polymerization reaction may be used. The polymerization may also be carried out in its addition in an amount of from 0.5 to 20 parts by weight based on 100 parts by weight of the polymerizable monomer. This enables production of a polymer having a maximum in the region of molecular weight of from 10,000 to 100,000, so that a toner having a suitable strength and melt characteristics can be obtained.

The polymerization may include azo type or diazo type polymerization initiators such as 2,2'-azobis-(2,4-dimethylvaleronitrile), 2,2'-azobisisobutyronitrile, 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, t-butyl peroxy-2-ethylhexanoate, t-butyl peroxypivarate, t-butyl peroxyisobutyrate, t-butyl peroxyneodecanoate, methyl ethyl ketone peroxide, diisopropyl peroxycarbonate, cumene hydroperoxide, 2,4-dichlorobenzoyl peroxide and lauroyl peroxide.

Of these polymerization initiators, a compound that is capable of forming the ether compound according to the present invention at the time of decomposition may also be selected and used. In this case, the amount in which it is used, polymerization conditions and so forth must be controlled to appropriate conditions. If sufficient polymerization does not proceed in using any polymerization initiator alone, the compound may be used in appropriate combination with other polymerization initiator.

In the production of the polymerization toner according to the present invention, a cross-linking agent may be added, which may preferably be added in an amount of from 0.001 to 15 parts by weight based on 100 parts by weight of the polymerizable monomer. The cross-linking agent may include divinylbenzene and so forth.

In the production of the polymerization toner according to the present invention, a molecular-weight modifier may be used. The molecular-weight modifier may include, e.g., mercaptans such as t-dodecyl mercaptan, n-dodecyl mercaptan and n-octyl mercaptan; halogenated hydrocarbons such as carbon tetrachloride and carbon tetrabromide; and α-methylstryrene diner. An of these molecular-weight modifier may be added before the initiation of polymerization or on the way of polymerization. The molecular-weight modifier may usually be used in a proportion of from 0.01 to 10 parts by weight, and preferably from 0.1 to 5 parts by weight, based on 100 parts by weight of the polymerizable monomer.

In the process of producing the polymerization toner according to the present invention, the colorant, optionally the ether compound, the resin having sulfur atoms, the release agent, a plasticizer, the charge control agent, the cross-linking agent, an organic solvent added in order to lower the viscosity of the polymer to be formed by polymerization reaction, a polymeric polymer, a dispersant and so forth are added to the polymerizable monomer, and dissolved or dispersed therein by means of a dispersion machine such as a homogenizer, a ball mill, a colloid mill or an ultrasonic dispersion machine to prepare a polymerizable monomer composition, which is then dropwise added to an aqueous medium containing a dispersion stabilizer, to effect suspension and granulation. Here, a high-speed stirrer or a high-speed dispersion machine such as an ultrasonic dispersion machine may be used to make the toner particles have the desired particle size at a stretch, and this can more readily make the resultant toner particles have a sharp particle size distribution.

As the time at which the polymerization initiator is added, it may be added simultaneously when other additives are added to the polymerizable monomer, or may be added immediately before the polymerizable monomer composition is suspended in the aqueous medium. Also, a polymerization initiator having been dissolved in the polymerizable monomer or solvent may be added before the polymerization reaction is initiated.

After granulation, agitation may be carried out using a usual agitator in such an extent that the state of particles is maintained and also the particles can be prevented from floating and settling.

In the case when the polymerization toner according to the present invention is produced, any known surface-active agents or organic or inorganic dispersants may be used as the dispersion stabilizer. In particular, where an inorganic dispersant is used, it may hardly cause any ultrafine powder, and may attain dispersion stability on account of its steric hindrance because the inorganic dispersant commonly has a large size. Hence, even when reaction temperature is changed, it may hardly loose the stability and can be washed with ease. Thus, the inorganic dispersant may preferably be used. As examples of such an inorganic dispersant, it may include phosphoric acid polyvalent metal salts such as calcium phosphate, magnesium phosphate, aluminum phosphate and zinc phosphate; carbonates such as calcium carbonate and magnesium carbonate; inorganic salts such as calcium metasilicate, calcium sulfate and barium sulfate; and inorganic oxides such as calcium hydroxide, magnesium hydroxide, aluminum hydroxide, silica, bentonite and alumina.

Any of these inorganic dispersants may be used alone in an amount of from 0.2 to 20 parts by weight based on 100 parts by weight of the polymerizable monomer, or, for the purpose of controlling particle size distribution, may be used in combination with a surface-active agent used in an amount of from 0.001 to 0.1 part by weight. Such a surface-active agent may include, e.g., sodium dodecylbenzenesulfate, sodium tetradecyl sulfate, sodium pentadecyl sulfate, sodium octyl sulfate, sodium oleate, sodium laurate, sodium stearate and potassium stearate.

The inorganic dispersant is substantially completely removable by dissolving it with an acid or alkali after the polymerization has been completed.

In the above step of polymerization, the polymerization may be carried out at a polymerization temperature set at 40° C. or more, and commonly at a temperature of from 50° C. to 90° C. Where the polymerization is carried out within this temperature range, the release agent to be enclosed in particles becomes deposited by phase separation and more perfectly enclosed in particles. In order to consume residual polymerizable monomers, the reaction temperature may be raised to 90° C. to 150° C. at the termination of polymerization reaction. After the polymerization is completed, the polymerization toner particles may be filtered, washed and dried by known methods, and an inorganic fine powder is mixed to make it adhere to the toner particle surfaces, thus the toner of the present invention can be obtained. Also, the step of classification may be added to the production process to remove any coarse powder and fine powder.

In the case when the toner of the present invention is produced by pulverization, any known method may be used. For example, components necessary as the toner, as exemplified by the binder resin, the ether compound according to the present invention, the colorant, and optionally the resin having sulfur atoms, the release agent, the charge control agent and so forth and other additives are thoroughly mixed by mean of a mixer such as a Henschel mixer or a ball mill, thereafter the mixture obtained is melt-kneaded by means of a heat kneading machine such as a heat roll, a kneader or an extruder to make the resin and so on melt one another, in which other toner materials such as a magnetic material are dispersed or dissolved. The resultant kneaded product is cooled to solidify, followed by pulverization, thereafter classification and optionally surface treatment to obtain toner particles, to which an inorganic fine powder is added and mixed, thus the toner of the present invention can be obtained.

Either of the classification and the surface treatment may be first in order. In the step of classification, a multi-division classifier may preferably be used in view of production efficiency. The pulverization step may be carried out by any method making use of a known pulverizer such as a mechanical impact type or a jet type. In order to obtain the toner having the specific circularity according to the present invention, it is preferable to further apply heat to effect pulverization or to add mechanical impact auxiliarily. Also usable are a hot-water bath method in which toner particles finely pulverized (and optionally classified) are dispersed in hot water, and a method in which the toner particles are passed through hot-air stream.

As means for applying mechanical impact force, available is, e.g., a method making use of a mechanical impact type pulverizer such as Kryptron system, manufactured by Kawasaki Heavy Industries, Ltd., or Turbo mill, manufactured by Turbo Kogyo K.K. Also available is a method in which toner particles are pressed against the inner wall of a casing by centrifugal force by means of a high-speed rotating blade to impart mechanical impact to the toner particles by the force such as compression force or frictional force, as exemplified by apparatus such as a mechanofusion system manufactured by Hosokawa Micron Corporation or a hybridization system manufactured by Nara Kikai Seisakusho.

When such a mechanical impact method is used, thermo-mechanical impact is applied to such an extent that the treatment temperature comes to be a temperature around glass transition temperature Tg of the toner particles (Tg plus-minus 10° C.). This is preferred from the viewpoint of prevention of agglomeration and productivity. More preferably the treatment may be made at a temperature of about plus-minus 5° C. of the glass transition temperature Tg of the toner particles, as being effective for the improvement of transfer efficiency.

The toner of the present invention may still also be produced by a method in which, as disclosed in Japanese Patent Publication No. S56-13945, a molten mixture is atomized in the air by means of a disk or a multiple fluid nozzle to obtain spherical toner particles.

As the binder resin used when the toner of the present invention is produced by pulverization, it may include polystyrene; homopolymers of styrene derivatives such as polyvinyl toluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; and polymethyl methacrylate, polybutyl methacrylate, polyvinyl acetate, polyethylene, polypropylene, polyvinyl butyral, silicone resins, polyester resins, polyamide resins, epoxy resins, polyacrylic acid resins, rosins, modified rosins, terpene resins, phenolic resins, aliphatic or alicyclic hydrocarbon resins, aromatic petroleum resins, paraffin wax, and carnauba wax, any of which may be used alone or in the form of a mixture. In particular, styrene copolymers and polyester resins are preferred in view of developing performance and fixing performance.

To the toner of the present invention, the inorganic fine powder is added in order to improve the fluidity of the toner and make its charging uniform. As the inorganic fine powder, preferred is one having an average primary particle diameter of from 4 nm to 80 nm.

If the inorganic fine powder has an average primary particle diameter of more than 80 nm, it can not well improve the fluidity of the toner, and also tends to adhere non-uniformly to toner particles, leading to non-uniform triboelectric charging performance in an environment of low humidity, to tend to cause problems of fogging greatly, a decrease in image density and a lowering of running performance. If the inorganic fine powder has an average primary particle diameter of less than 4 nm, the inorganic fine powder may strongly be susceptible to agglomerate, and tends to behave not as primary particles but as agglomerates having a broad particle size distribution which are so strongly agglomerative as to break up with difficulty even by disintegration treatment, so that the agglomerates may be developed or may scratch the image-bearing member or toner-carrying member to tend to cause faulty images. In order to more uniform the charge quantity distribution of the toner particles, the inorganic fine powder may more preferably have an average primary particle diameter of from 6 nm to 35 nm.

The average primary particle diameter of the inorganic fine powder may be measured in the following way. On a photograph of toner particles, magnified with a scanning electron microscope, and further comparing it with a photograph of toner particles mapped with elements the inorganic fine powder contains, by an elemental analysis means such as XMA (X-ray microanalyzer) attached to the scanning electron microscope, at least 100 primary particles of the inorganic fine powder which are present in the state they adhere to or liberate from toner particle surfaces are observed to measure their number-average primary particle diameter.

The content of the inorganic fine powder may also be determined by fluorescent X-ray analysis and using a calibration curve prepared from a standard sample.

As the inorganic fine powder to be added to the toner particles of the present invention, usable are fine powders of silica, titanium oxide and alumina or a double oxide of any of these.

For example, as the fine silica powder, usable are fine silica powder which is what is called dry-process silica or fumed silica produced by vapor phase oxidation of silicon halides and fine silica powder which is what is called wet-process silica produced from water glass or the like, either of which may be used. The dry-process silica is preferred, as having less silanol groups on the particle surface and inside of the fine silica powder and leaving less production residues such as $Na_2O$ and $SO_3^{2-}$. In the dry-process silica, it is also possible to use, in its production step, other metal halide such as aluminum chloride or titanium chloride together with the silicon halide to give a composite fine powder of silica with other metal oxide. The fine silica powder includes these as well.

The inorganic fine powder may preferably be added in an amount of from 0.1 to 4.0 parts by weight based on 100 parts by weight of the toner particles. In its addition in an amount of less than 0.1 part by weight, it may insufficiently be effective. Its addition in an amount of more than 4.0 parts by weight tends to cause a lowering of fixing performance.

In view of the improvement in performance in an environment of high humidity, the inorganic fine powder may preferably be a powder having been subjected to hydrophobic treatment. If the inorganic fine powder added to the toner particles has moistened, the charge quantity required as the toner may greatly lower to tend to cause a lowering of developing performance and transfer performance.

As a treating agent used for such hydrophobic treatment, usable are treating agents such as a silicone varnish, a modified silicone varnish of various types, a silicone oil, a modified silicone oil of various types, a silane compound, a silane coupling agent, other organic silicon compound and an organic titanium compound, any of which may be used alone or in combination for the treatment.

In particular, those having been treated with a silicone oil are preferred. Those obtained by subjecting the inorganic fine powder to treatment with a silicone oil simultaneously with the hydrophobic treatment or after that treatment are more preferred in order to maintain the charge quantity of the toner particles at a high level even in an environment of high humidity and to restrain selective development.

As conditions for such treatment of the inorganic fine powder, for example, as first-stage reaction, silylation reaction may be effected to cause surface active hydrogen groups to disappear by chemical coupling, and thereafter, as second-stage reaction, treatment with the silicone oil is carried out to form hydrophobic thin films on particle surfaces. Such a silylating agent may be used in an amount of from 5 to 50 parts by weight based on 100 parts by weight of the inorganic fine powder. If it is in an amount of less than 5 parts by weight, it is insufficient for making the active hydrogen groups on the inorganic fine powder particle surfaces to disappear. If it is in an amount of more than 50 parts by weight, a siloxane compound formed upon mutual reaction of any excess silylating agents may serve as glue to cause mutual agglomeration of inorganic fine powder particles to tend to cause image defects.

The above silicone oil may preferably be one having a viscosity at 25° C. of from 10 to 200,000 $mm^2/s$, and more preferably from 3,000 to 80,000 $mm^2/s$. If its viscosity is less than 10 $mm^2/s$, the inorganic fine powder may have no stability, and the image quality tends to lower because of thermal and mechanical stress. If its viscosity is more than 200,000 $mm^2/s$, it tends to be difficult to carry out uniform treatment.

As a method for treating the inorganic fine powder with the silicone oil, for example the inorganic fine powder having been treated with a silane compound and the silicone oil may directly be mixed by means of a mixer such as a Henschel mixer, or a method may be used in which the silicone oil is sprayed on the inorganic fine powder. Besides, a method may be used in which the silicone oil is dissolved or dispersed in a suitable solvent and thereafter the inorganic fine powder is added and mixed, followed by removal of the solvent. In view of an advantage that agglomerates of the inorganic fine powder may less occur, the method making use of a sprayer is preferred.

The silicone oil may be used for the treatment in an amount of from 1 to 23 parts by weight, and preferably from 5 to 20 parts by weight, based on 100 parts by weight of the inorganic fine powder. If the silicone oil is in a too small quantity, the inorganic fine powder can not be made well hydrophobic. If it is in a too large quantity, the inorganic fine powder particles tend to agglomerate also.

In order to improve cleaning performance and so forth, inorganic or organic closely spherical fine particles having a primary particle diameter of more than 30 nm (preferably having a BET specific surface area of less than 50 $m^2/g$), and more preferably a primary particle diameter of more than 50 nm (preferably having a BET specific surface area of less than 30 $m^2/g$), may further be added to the toner of the present invention. For example, spherical silica particles, spherical polymethyl silsesquioxane particles and spherical resin particles may preferably be used.

In the toner of the present invention, other additives may also be used in such a quantity that their addition substantially does not adversely affect the toner, which may include, e.g., lubricant powders such as polyethylene fluoride powder, zinc stearate powder and polyvinylidene fluoride powder; abrasives such as cerium oxide powder, silicon carbide powder and strontium titanate powder; and anti-caking agents. Reverse-polarity organic particles and inorganic particle may also be used in a small quantity as a developability improver. These additives may also be used after hydrophobic treatment of their particle surfaces.

In the present invention, the inorganic fine powder may preferably have a liberation percentage of from 0.05% to 10.00%, more preferably from 0.10% to 5.00%, still more preferably from 0.10% to 3.00%, and particularly preferably from 0.10% to 1.30%.

According to examination made by the present inventors, if the inorganic fine powder has a liberation percentage of less than 0.05%, fog and coarse images tend to appear during running, in particular, during running in an environment of high temperature and high humidity. In general, in the environment of high temperature, the external additives tend to come buried in toner particles because of a stress coming from a charge regulation member and so forth, and the toner may come to have a fluidity inferior to that at the initial stage after printing on many sheets to cause the above problems, as so considered. However, as long as the inorganic fine powder has a liberation percentage of 0.05% or more, such problems can not easily come about. This is considered due to the fact that the presence of the inorganic fine powder in the state that it has been liberated to a certain extent makes the toner have good fluidity, and hence makes the inorganic fine powder not easily buried in toner particles as a result of running, and also that, even if the inorganic fine powder adhering to toner particles has come buried therein, the liberated inorganic fine powder adheres to toner particle surfaces to make the fluidity of the toner less lower.

If on the other hand the inorganic fine powder has a liberation percentage of more than 10.00%, the liberated inorganic fine powder may contaminate the charge regulation member to cause heavy fog undesirably. Also, in such a state, the charging uniformity of the toner as well may be damaged to tend to cause faulty cleaning. As long as the inorganic fine powder has a liberation percentage of 5.00% or less, the above difficulties can be made to much less occur. Where it has a liberation percentage of 3.00% or less, the above difficulties can be made to still much less occur.

The liberation percentage of the inorganic fine powder, e.g., fine silica powder, may be measured from emission spectra obtained when the toner is introduced into plasma. Herein, the liberation percentage is a value defined from the following equation, on the basis of the simultaneousness of light emission of carbon atoms which are constituent elements of the binder resin and light emission of silicon atoms. Liberation percentage (%) of fine silica powder=100×[(the number of light emissions of only silicon atoms)/(the number of light emissions of silicon atoms having emitted light simultaneously with carbon atoms+the number of light emissions of only silicon atoms)]

Here, as to the "having emitted light simultaneously", the light emission of inorganic elements (silicon atoms in the case of the fine silica powder) having emitted light within 2.6 msec after the light emission of carbon atoms is regarded as simultaneous light emission, and light emission of inorganic elements after that is regarded as light emission of only the inorganic elements.

In the present invention, what is meant by the fact of simultaneous light emission of carbon atoms and inorganic elements is that the toner particles contain the inorganic fine powder fine silica powder, and the light emission of only inorganic elements can be said in other words to mean that the inorganic fine powder stands liberated from toner particles.

The above liberation percentage of the inorganic fine powder may be measured on the basis of the principle described in Japan Hardcopy '97 Papers, pages 65–68. In the case when such measurement is made, preferably used is, e.g., a particle analyzer (PT1000, manufactured by Yokogawa Denki K.K.). Stated specifically, in this analyzer, fine particles such as toner particles are individually led into plasma, and the element(s) which emit(s) light, number of particles and particle diameter of particles can be known from emission spectra of the fine particles.

A specific measuring method therefor which makes use of the above measuring instrument is described below for the case of the fine silica powder. Using helium gas containing 0.1% of oxygen, measurement is made in an environment of 23° C. and 60% humidity. As a toner sample, a sample having been moisture conditioned by leaving it overnight in the same environment is used in the measurement. Also, carbon atoms are measured in channel 1 (measurement wavelength: 247.860 nm; a recommended value is used as K-factor), and silicon atoms in channel 2 (measurement wavelength: 288.160 nm; a recommended value is used as K-factor). Sampling is so carried out that the number of light emissions of carbon atoms comes to be 1,000 to 1,400 in one scanning, and the scanning is repeated until the number of light emission of carbon atoms comes to be 10,000 atoms or more in total, where the number of light emissions is calculated by addition. Here, the measurement is made by sampling carried out in such a way that, in distribution given by plotting the number of light emissions of carbon atoms as ordinate and the cubic root voltage of carbon atoms as abscissa, the distribution has one peak and also no valley is present therein. Then, on the basis of the data thus obtained, the liberation percentage of the silicon atoms, i.e., fine silica powder is calculated using the above calculation expression, setting the noise-cut level of all elements at 1.50 V.

The liberation percentage of the inorganic fine powder in the present invention is defined to be the total sum of the liberation percentage obtained for each inorganic element.

In the present invention, the liberation percentage of the inorganic fine powder may be changed by selecting the strength of external addition, the type and quantity of the external additives. More specifically, the liberation percentage lowers when the strength of external addition is made high or the quantity of the external additives is made small.

In the present invention, in a water/methanol wettability test on the toner, the methanol concentration ($C_S$: % by volume) measured when transmittance begins to lower and the methanol concentration ($C_E$: % by volume) measured when transmittance finishes lowering may preferably satisfy the following relation:

$$3 \leqq \{(C_E)-(C_S)\} \leqq 15.$$

When this value is small, it means that the state of adhesion of external additives is uniform. If, however, the value of the above expression is less than 3, there is a high possibility that a stress more than is necessary has been imparted to toner particles in order to make the external additives adhere uniformly thereto, and has made the toner particles deteriorate. If on the other hand the value of the above expression is more than 15, it follows that the state of adhesion of external additives is not uniform, making it difficult to achieve good charging performance.

Water/Methanol Hydrophobicity (Hydrophobic Degree) of Toner:

The point at which toner's hydrophobicity (methanol wettability) starts to drop is measured with a powder wettability tester WET-100P (manufactured by Rhesca Company, Limited). First, 48 ml of pure water (ion-exchanged water or commercially available purified water) and 12 ml of methanol are put into a 100 ml beaker, which is then stoppered, followed by uniform dispersion by means of an ultrasonic dispersion machine or the like. Then, 0.1 g of the toner is precisely weighed and added, and methanol is added on at a rate of 0.8 ml/min with stirring by means of a stirrer at 300 revolutions per minute. The transmittance of the aqueous solution lowers when the toner begins to settle and disperse in the solution. Accordingly, the proportion (%) of methanol/(methanol+water) is regarded as the toner's hydrophobicity drop start point. Upon reach to a methanol level higher than a certain level, the transmittance of the solution comes to no longer change. Accordingly, the proportion (%) of methanol/(methanol+water) at this point is regarded as the toner's hydrophobicity drop end point.

Image formation making use of the toner of the present invention is described below.

As a condition for the step of development in an image-forming method to which the toner of the present invention is applicable, a toner-carrying member and an electrostatic latent image bearing member photosensitive member may be in contact or in non-contact. Here, a case in which they are in contact is described.

As the toner-carrying member, an elastic roller may be used and a method may be used in which the toner is coated on the elastic roller surface and the coated toner is brought into contact with the photosensitive member surface. As the elastic roller, a roller may preferably be used whose elastic layer has an ASKER-C hardness of from 30 to 60 degrees. Where the development is performed in the state the toner-carrying member and the photosensitive member surface are brought into contact with each other, the development is performed by the aid of an electric field acting between the photosensitive member and the elastic roller facing the photosensitive member surface through the toner. Hence, it is necessary for the elastic roller surface or the vicinity of the surface to have a potential so that an electric field is formed at a narrow gap between the photosensitive member surface and the toner-carrying member surface. Accordingly, a method may also be used in which an elastic rubber of the elastic roller is controlled to have a resistance in the medium-resistance region to keep the electric field while preventing its conduction to the photosensitive member surface, or a thin-layer insulating layer is provided on the surface layer of a conductive roller. It is also possible to use a resin-coated conductive sleeve comprising a conductive roller coated thereon with an insulating substance (resin) on its side facing the photosensitive member surface, or an insulating sleeve provided with a conductive layer on its side not facing the photosensitive member. It is still also possible to use a rigid-material roller as the toner-carrying member and use a flexible member such as a belt as the photosensitive member.

The toner-carrying member may preferably have a resistivity in the range of from $10^2$ to $10^9$ Ω·cm. If it has a resistivity lower than $10^2$ Ω·cm, there is a possibility that an excess electric current flows when, e.g., pinholes are present at the surface of the photosensitive member. On the other hand, if it has a resistivity higher than $10^9$ Ω·cm, the toner tends to cause charge-up due to triboelectric charging to tend to cause a decrease in image density.

As the state of surface of the toner-carrying member, its surface roughness Ra (μm) may be so set as to be from 0.2 to 3.0. This enables achievement of both high image quality and high running performance. The surface roughness Ra correlates with toner transportability and toner chargeability. If the toner-carrying member has a surface roughness Ra of more than 3.0, not only the toner layer on the toner-carrying member can be made thin with difficulty but also the charging performance of the toner may be not improved, and hence no improvement in image quality can be expected. Setting the Ra to be 3.0 or less enables control of the toner transportability the toner-carrying member surface has, and makes thin the toner layer on the toner-carrying member, and also makes large the number of times the toner-carrying member comes into contact with the toner. Hence, the charging performance of the toner can also be improved to cooperatively bring an improvement in image quality. On the other hand, if the toner-carrying member has a surface roughness Ra smaller than 0.2, it is difficult to control toner coat quantity.

The toner may preferably be coated on the toner-carrying member in a quantity of from 0.1 mg/cm$^2$ to 1.5 mg/cm$^2$. If coated in a quantity of less than 0.1 mg/cm$^2$, it is difficult to attain a sufficient image density, and, in a quantity of more than 1.5 mg/cm$^2$, it is difficult to uniformly triboelectrically charge all the individual toner particles, providing a factor of causing fog. It may more preferably be coated in a quantity of from 0.2 mg/cm$^2$ to 0.9 mg/cm$^2$.

In the present invention, the surface roughness Ra of the toner-carrying member corresponds to centerline average roughness measured with a surface roughness measuring device (SURFCOADER SE-30H, manufactured by K.K. Kosaka Kenkyusho) according to JIS surface roughness "JIS B-0601". Stated specifically, a portion of 2.5 mm is drawn out of the roughness curve, setting a measurement length a in the direction of its centerline. When the centerline of this drawn-out portion is represented by X axis, the direction of lengthwise magnification by Y axis, and the roughness curve by y=f(x), the value determined according to the following expression and indicated in micrometer (μm) is the surface roughness Ra.

$$Ra=1/a \int_0^a |f(x)|dx$$

In the image-forming method making use of the toner of the present invention, the toner-carrying member may be rotated in the same direction as, or the reverse direction to, the photosensitive member at the former's zone facing the latter. In the case when the both are rotated in the same direction, the peripheral speed of the toner-carrying member may be set 1.05 to 3.0 times the peripheral speed of the photosensitive member.

If the peripheral speed of the toner-carrying member is less than 1.05 times the peripheral speed of the photosensitive member, the agitation effect on the toner layer may be insufficient, so that no good image quality may be expected. If on the other hand their peripheral speed ratio is more than 3.0, the deterioration of toner that is due to mechanical stress or the sticking of toner to the toner-carrying member may occur and be accelerated undesirably.

As the photosensitive member, preferably used is a photosensitive drum or photosensitive belt having a photoconductive insulating material layer formed of a-Se, CdS, $ZnO_2$, OPC (organic photoconductor) or a-Si.

An organic photosensitive layer in an OPC photosensitive member may be of a single-layer type in which the photosensitive layer contains a charge generating material and a charge transporting material in the same layer, or may be a function-separated photosensitive layer composed of a charge transport layer and a charge generation layer. A multi-layer type photosensitive layer comprising a conductive substrate and superposingly formed thereon the charge generation layer and the charge transport layer in this order is one of preferred examples. As binder resins for the organic photosensitive layer, there are no particular limitations thereon. Polycarbonate resins, polyester resins or acrylic resins may preferably be used because they provide a good transfer performance, and can not easily cause melt-adhesion of toner to the photosensitive member and filming of external additives.

Image formation making use of the toner of the present invention is described below with reference to the accompanying drawings.

In FIG. 1, reference numeral 100 denotes a developing assembly; 109, a photosensitive member; 105, a transfer medium such as paper; 106, a transfer member; 107, a fixing pressure roller; 108, a fixing heating roller; and 110, a primary charging member which directly charges the photosensitive member 109 in contact with it.

To the primary charging member 110, a bias power source 115 is connected so that the surface of the photosensitive member 109 is uniformly charged.

The developing assembly 100 holds a toner 104, and has a toner-carrying member 102 which is rotated in the direction of an arrow in contact with the electrostatic latent image bearing member photosensitive member 109. It also has a developing blade 101 for controlling toner quantity and charging the toner, and a coating roller 103 which is rotated in the direction of an arrow in order to cause the toner 104 to adhere to the toner-carrying member 102 and also charge the toner by its friction with the toner-carrying member 102. To the toner-carrying member 102, a development bias power source 117 is connected. A bias power source (not shown) is also connected to the coating roller 103, where a voltage is set on the negative side with respect to the development bias when a negatively chargeable toner is used and on the positive side with respect to the development bias when a positively chargeable toner is used.

A power source 116 for transfer bias with a polarity reverse to that of the photosensitive member 109 is connected to the transfer member 106.

Here, the length of rotational direction, what is called development nip width, at the contact zone between the photosensitive member 109 and the toner-carrying member 102 may preferably be from 0.2 mm to 8.0 mm. If it is less than 0.2 mm, the amount of development may be too insufficient to attain a satisfactory image density and also the transfer residual toner may not be well collected. If it is more than 8.0 mm, the toner may be fed in excess to tend to cause fog and also tend to cause the wear of the photosensitive member seriously. The toner also tends to cause charge-up to tend to cause a decrease in image density.

The toner coat quantity is controlled by the developing blade 101. This developing blade 101 is kept in contact with the toner-carrying member 102 through the toner layer. Here, its contact pressure may be from 4.9 to 49 N/m (5 to 50 gf/cm) as a preferable range. If the contact pressure is lower than 4.9 N/m, it may be difficult not only to control the toner coat quantity but also to effect uniform triboelectric charging, causing fog to occur. On the other hand, if the contact pressure is higher than 49 N/m, the toner particles may undergo an excess load to tend to cause deformation of particles or the melt-adhesion of toner to the developing blade or toner-carrying member, undesirably.

The fee edge of the toner quantity control member developing blade 101 may have any shape as long as it affords a preferable NE length (the length extending from the zone where the developing blade comes in contact with the toner-carrying member to the free edge). For example, its sectional shape may be linear, and besides may be in L-shape, bent in the vicinity of the edge, or may be in a shape made spherical in the vicinity of the edge, any of which may preferably be used.

As a toner coat quantity control member, a rigid metallic blade or the like may also be used besides the elastic blade for coating the toner in pressure contact.

As the elastic control member, it is preferable to select a material of triboelectric series suited for charging the toner electrostatically to the desired polarity, which includes rubber elastic materials such as silicone rubber, urethane rubber or NBR; synthetic resin elastic materials such as polyethylene terephthalate; and metallic elastic materials such as stainless steel, steel and phosphor bronze, as well as composite materials thereof, any of which may be used.

Where the elastic control member and the toner-carrying member are required to have a durability, resin or rubber may preferably be stuck to, or coated on, the metal elastic material so as to touch the part coming into contact with the sleeve.

An organic or inorganic substance may be added to, may be melt-mixed in, or may be dispersed in, the elastic control member. For example, any of metal oxides, metal powders, ceramics, carbon allotropes, whiskers, inorganic fibers, dyes, pigments and surface-active agents may be added so that the charging performance of the toner can be controlled. Especially when the elastic member is formed of a molded product of rubber or resin, a fine metal oxide powder such as silica, alumina, titania, tin oxide, zirconia or zinc oxide, carbon black, or a charge control agent commonly used in toners may preferably be incorporated therein.

A DC electric field and/or an AC electric field may also be applied to the control member, whereby the uniform thin-layer coating performance and uniform charging performance can be more improved because of the loosening action acting on the toner, so that a sufficient image density can be achieved and images with a good quality can be formed.

As a charging member, it includes a non-contact type corona charging assembly and a contact type charging member making use of a roller or the like, either of which may be used. The contact charging type may preferably be used in order to enable efficient and uniform charging, simplify the system and make ozone less occur.

In what is shown in FIG. 1, a contact type charging member is used.

The primary charging member (roller) 110 shown in FIG. 1 is constituted basically of a mandrel **110*b* at the center and a conductive elastic layer 110*a* that forms the periphery of the former. The charging roller 110 is brought into contact with the surface of the photosensitive member 109 under a pressing force and is rotated followingly as the photosensitive member 109** is rotated.

When the charging roller is used, the charging process may preferably be performed under conditions of a roller contact pressure of 4.9 to 490 N/m (5 to 500 gf/cm), and an AC voltage of 0.5 to 5 kVpp, an AC frequency of 50 Hz to 5 kHz and a DC voltage of plus-minus 0.2 to plus-minus 1.5 kV when a voltage formed by superimposing an AC voltage on a DC voltage is used as applied voltage, and a DC voltage of from plus-minus 0.2 to plus-minus 5 kV when a DC voltage is applied. Incidentally, in order to enable control of the depth of wear of the drum (photosensitive member), the case in which only the DC voltage is used as applied voltage is more preferred.

As a contact charging means other than the charging roller, there are available a method making use of a charging blade and a method making use of a conductive brush. These contact charging means are advantages in that they make high voltage unnecessary and make ozone less occur, compared with non-contact corona charging. The charging roller and charging blade as contact charging means may preferably be made of a conductive rubber, and a release coat may be provided on its surface. The release coat may be formed of a nylon resin, PVDF (polyvinylidene fluoride) or PVDC (polyvinylidene chloride), any of which may be used.

Incidentally, as description of the image-forming apparatus shown in FIG. 1, it has been described on the contact charging means. The same apparatus and conditions may also be used in image-forming apparatus constructed differently, as long as the contact charging means is used.

Subsequently to the primary charging step, an electrostatic latent image corresponding to information signals is formed on the photosensitive member 109 by exposure 123 from a light-emitting device, and the electrostatic latent image is developed into a visible image by the use of the toner at the position coming into contact with the toner-carrying member 102. Also, in the image forming method of the present invention, especially a development system of forming a digital latent image on the photosensitive member may be used in combination. This enables development faithful to a dot latent image because the latent image is not disordered. Then, the visible image (toner image) is transferred to the transfer medium 105 by means of the transfer member 106. The toner image thus transferred is passed through between the heating roller 108 and the pressure roller 107, and is fixed there to obtain a fixed image. Incidentally, as such a heat-and-pressure fixing means, a heat roll system may be used which is constituted basically of a heating roller internally provided with a heating element such as a halogen heater and an elastic-material pressure roller brought into contact therewith under pressing force, and besides a system may also be used in which the toner image is fixed by heat by means of a heater through a film.

Meanwhile, any transfer residual toner not transferred and remaining on the photosensitive member 109 is collected by means of a cleaner 138 having a cleaning blade brought into touch with the surface of the photosensitive member 109, so that the photosensitive member 109 is cleaned.

Image forming methods and apparatus units which make use of the toner of the present invention are described below with reference to the drawings.

Figure 2:
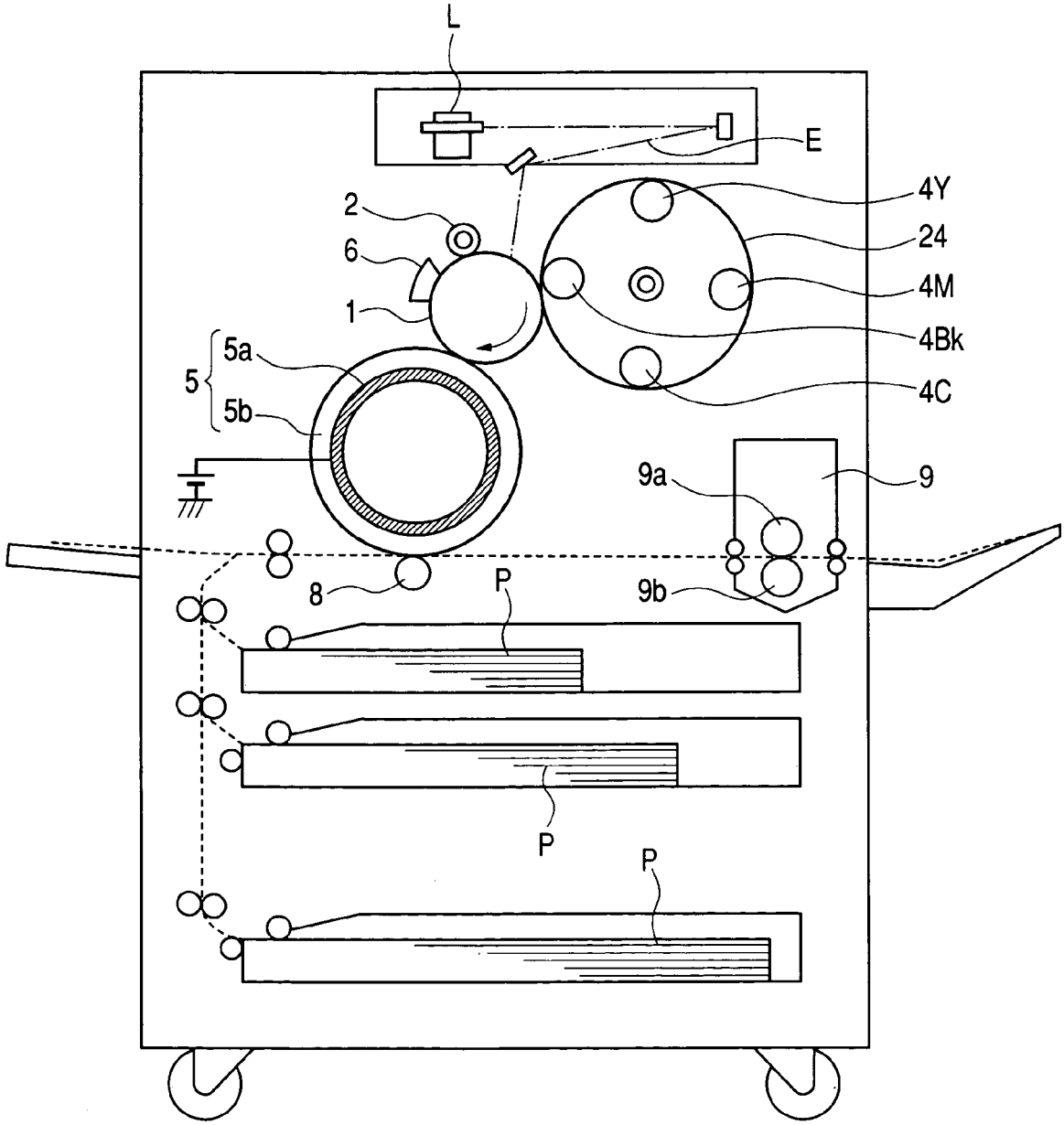
FIG. 2 is a schematic view showing an example of an image-forming apparatus making use of an intermediate transfer drum.
Figure 3:
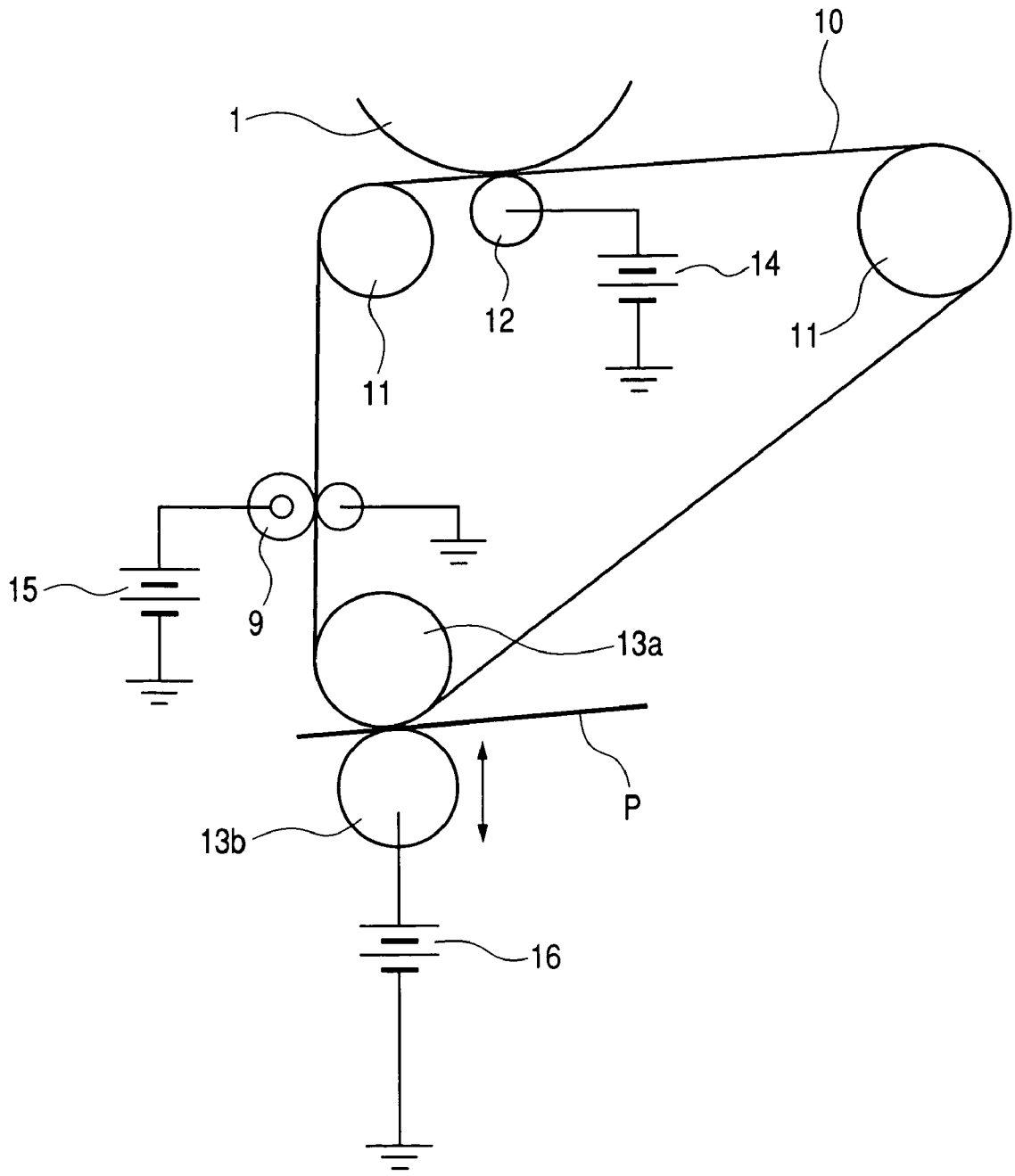
FIG. 3 illustrates an example of the constitution of an intermediate transfer belt.

FIGS. 2 and 3 schematically illustrate image forming apparatus in which a multiple toner image is one-time transferred to a recording medium by an image forming method making use of the toner of the present invention, using an intermediate transfer member.

A charging roller 2 to which a charging bias voltage is kept applied is brought into contact with the surface of an electrostatic latent image bearing member (photosensitive drum) 1 as an image-bearing member while rotating the charging roller 2, to effect primary charging of the photosensitive drum surface. Then, a first electrostatic latent image is formed on the photosensitive drum 1 by its exposure to laser light E emitted from a light-source L as an exposure means. The first electrostatic latent image thus formed is developed by the use of a black toner held in a black developing assembly 4Bk as a first developing assembly, to form a black toner image; the developing assembly being provided in a rotatable rotary unit 24. The black toner image formed on the photosensitive drum 1 is primarily electrostatically transferred onto an intermediate transfer drum 5 by the action of a transfer bias voltage applied to a conductive support of the intermediate transfer member.

Next, a second electrostatic latent image is formed on the surface of the photosensitive drum 1 in the same way as the above, and the rotary unit 24 is rotated to develop the second electrostatic latent image by the use of a yellow toner held in a yellow developing assembly 4Y as a second developing assembly, to form a yellow toner image. The yellow toner image is primarily electrostatically transferred onto the intermediate transfer drum 5 on which the black toner image has primarily been transferred.

Similarly, a third electrostatic latent image is formed and, rotating the rotary unit 24, it is developed by the use of a magenta toner held in a magenta developing assembly 4M as a third developing assembly, Then, a fourth electrostatic latent image is further formed and, rotating the rotary unit 24, it is developed by the use of a cyan toner held in a cyan developing assembly 4C as a fourth developing assembly, and these toner images formed are primarily transferred in order. Thus, the respective-color toner images are primarily respectively transferred onto the intermediate transfer drum 5.

The toner images primarily transferred as a multiple toner image onto the intermediate transfer drum 5 are secondarily electrostatically one-time transferred onto a recording medium P by the action of a transfer bias voltage applied from a second transfer means 8 positioned on the opposite side via the recording medium P. The multiple toner image secondarily transferred onto the recording medium P is heat-fixed to the recording medium P by means of a fixing assembly 9 having a heat roller 9*a* and a pressure roller 9*b*. Transfer residual toner remaining on the surface of the photosensitive drum after transfer is collected by a cleaner 6 having a cleaning blade coming in contact with the surface of the photosensitive drum 1, thus the photosensitive drum is cleaned.

For the primary transfer from the photosensitive drum 1 to the intermediate transfer drum 5, a transfer bias is applied from a power source (not shown) to the conductive support of the intermediate transfer drum 5 serving as a first transfer means, thus the toner images can be transferred.

The intermediate transfer drum 5 comprises a conductive support 5*a* which is a rigid body and an elastic layer 5*b* which covers its surface.

The conductive support 5*a* may be formed using a metal or alloy such as aluminum, iron, copper or stainless steel, or a conductive resin with carbon or metal particles dispersed therein. As its shape, it may be a cylinder, a cylinder through the center of which a shaft is passed, or a cylinder reinforced on its inside.

The elastic layer 5*b* may preferably be formed using, but not particularly limited to, an elastomer rubber including styrene-butadiene rubber, high styrene rubber, butadiene rubber, isoprene rubber, an ethylene-propyelne copolymer, EPDM (an ethylene-propylene-diene terpolymer), nitrile butadiene rubber (NBR), chloroprene rubber, butyl rubber, silicone rubber, fluororubber, nitrile rubber, urethane rubber, acrylic rubber, epichlorohydrin rubber and norbornane rubber. Resins such as polyolefin resins, silicone resins, fluorine resins, polycarbonate resins, and copolymers or mixtures of any of these may also be used.

On the surface of the elastic layer, a surface layer may further be formed in which a highly lubricating and water-repellent lubricant powder has been dispersed in any desired binder.

There are no particular limitations on the lubricant. Preferably usable are various fluororubbers, fluoroelastomers, and carbon fluorides comprising fluorine-bonded graphite; fluorine compounds such as polytetrafluoroethylene, polyvinylidene fluoride, ethylene-tetrafluoroethylene copolymer and tetrafluoroethylene-perfluoroalkyl vinyl ether copolymers; silicone compounds such as silicone resins, silicone rubbers and silicone elastomers; and polyethylene, polypropylene, polystyrene, acrylic resins, polyamide resins, phenolic resins, and epoxy resins.

In the binder of the surface layer, a conducting agent may appropriately be added in order to control its resistance. The conducting agent may include various conductive inorganic particles, carbon black, ionic conducting agents, conductive resins and conductive-particle-dispersed resins.

The multiple toner image formed on the intermediate transfer drum 5 is secondarily one-time transferred onto the recording medium P by means of the second transfer means 8. Usable as the transfer means 8 is a non-contact electrostatic transfer means such as a corona charging assembly, or a contact electrostatic transfer means such as a transfer roller or a transfer belt.

In the case when the transfer roller is used, the elastic layer of the transfer roller may be made to have a volume resistivity set smaller than the volume resistivity of the elastic layer of the intermediate transfer drum, whereby the voltage applied to the transfer roller can be lessened, good toner images can be formed on the transfer medium and also the transfer medium can be prevented from being wound around the intermediate transfer drum. In particular, the elastic layer of the intermediate transfer drum may preferably have a volume resistivity at least 10 times the volume resistivity of the elastic layer of the transfer roller.

The hardness of the intermediate transfer drum and transfer roller is measured according to JIS K-6301. The intermediate transfer drum used in the present invention may preferably be constituted of an elastic layer with a hardness in the range of from 10 to 40 degrees. As for the hardness of the transfer roller, the transfer roller may preferably have an elastic layer with a hardness higher than the hardness of the elastic layer of the intermediate transfer drum and has a value of from 41 to 80 degrees, in order to prevent the transfer medium from being wound around the intermediate transfer drum. If the intermediate transfer drum and the transfer roller have a reverse hardness, a concave may be formed on the transfer roller side to tend to cause the transfer medium to wind around the intermediate transfer drum.

As a fixing assembly 9, in place of the heat roller fixing assembly having a heating roller 9*a* and a pressure roller 9*b*, a film heat-fixing assembly may be used which heat-fixes the multiple toner image onto the recording medium P by heating a film coming in contact with the toner images on the recording medium P and thereby heating the toner images held on the recording medium P.

In place of the intermediate transfer drum as the intermediate transfer member used in the image-forming apparatus shown in FIG. 2, an intermediate transfer belt may be used to one-time transfer the multiple toner image to the recording medium. Such an intermediate transfer belt is constituted as shown in FIG. 3.

In the course the toner images formed and held on the electrostatic latent image bearing member (photosensitive drum) 1 pass a nip between the photosensitive drum 1 and an intermediate transfer belt 10, they are primarily transferred sequentially to the periphery of the intermediate transfer belt 10 by the aid of an electric field formed by a primary transfer bias applied to the intermediate transfer belt 10 through a primary transfer roller 12. Reference numeral 11 denotes a roller over which the intermediate transfer belt 10 is stretched.

The primary transfer bias for the sequential superimposing transfer of the first- to fourth-color toner images from the photosensitive drum 1 to the intermediate transfer belt 10 has a polarity reverse to that of the toner and is applied from a bias power source 14.

In the step of the primary transfer of the first- to third-color toner images from the photosensitive drum 1 to the intermediate transfer belt 10, the secondary transfer roller 13*b* and a cleaning charging member 9 may stand apart from the intermediate transfer belt 10.

Reference numeral 13*b* denotes a secondary transfer roller, which is axially supported in parallel to a secondary transfer opposing roller 13*a* and is so provided as to be separable from the bottom part of the intermediate transfer belt 10.

To transfer to a transfer medium P a multi-color toner image transferred onto the intermediate transfer belt 10, the secondary transfer roller 13*b* is brought into contact with the intermediate transfer belt 10 and also the transfer medium P is fed to the contact nip between the intermediate transfer belt 10 and the secondary transfer roller 13*b* at a given timing, where a secondary transfer bias is applied from a bias power source 16 to the secondary transfer roller 13*b*. By the aid of this secondary transfer bias, the multi-color toner image is secondarily transferred from the intermediate transfer belt 10 to the transfer medium P.

After the image transfer to the transfer medium P is completed, the cleaning charging member 9 is brought into contact with the intermediate transfer belt 10, and a bias having a polarity reverse to that of the photosensitive drum 1 is applied from a bias power source 15, so that electric charges having a polarity reverse to that of the photosensitive drum 1 are imparted to the toner (transfer residual toner) remaining on the intermediate transfer belt 10 without being transferred to the transfer medium P.

The transfer residual toner is electrostatically transferred to the photosensitive drum 1 at the nip between the intermediate transfer belt 10 and the photosensitive drum 1 and in the vicinity thereof, thus the intermediate transfer belt 10 is cleaned.

The intermediate transfer belt 10 comprises a beltlike base layer and a surfacing layer provided on the base layer. The surfacing layer may be constituted of a plurality of layers. In the base layer and the surfacing layer, rubber, elastomer or resin may be used.

For example, as the rubber and the elastomer, usable are one or more materials selected from the group consisting of natural rubber, isoprene rubber, styrene-butadiene rubber, butadiene rubber, butyl rubber, ethylene-propylene rubber, ethylene-propylene terpolymer, chloroprene rubber, chlorosulfonated polyethylene, chlorinated polyethylene, acrylonitrile butadiene rubber, urethane rubber, syndioctactic 1,2-polybutadiene, epichlorohydrin rubber, acrylic rubber, silicone rubber, fluororubber, polysulfide rubbers, polynorbornane rubber, hydrogenated nitrile rubbers, and thermoplastic elastomers (e.g., polystyrene type, polyolefin type, polyvinyl chloride type, polyurethane type, polyamide type, polyester type and fluorine resin type elastomers). However, examples are by no means limited to these materials.

As the resin, resins such as polyolefin resins, silicone resins, fluorine resins and polycarbonate resins may be used. Copolymers or mixtures of any of these resins may also be used.

As the base layer, a core material layer having the form of woven fabric, nonwoven fabric, yarn or film on one side or both sides of which any of the above rubbers, elastomers and resins is coated, soaked or sprayed may be used.

As materials constituting the core material layer, usable are, but not particularly limited to, one or more materials selected from the group consisting of, e.g., natural fibers such as cotton, silk, linen and wool; regenerated fibers such as chitin fiber, alginic acid fiber and regenerated cellulose fiber; semisynthetic fibers such as acetate fiber; synthetic fibers such as polyester fiber, nylon fiber, acrylic fiber, polyolefin fiber, polyvinyl alcohol fiber, polyvinyl chloride fiber, polyvinylidene chloride fiber, polyurethane fiber, polyalkylparaoxybenzoate fiber, polyacetal fiber, aramid fiber, polyfluoroethylene fiber and phenol fiber; inorganic fibers such as carbon fiber, glass fiber and boron fiber; and metal fibers such as iron fiber and copper fiber.

A conducting agent may further be added to the base layer and surfacing layer in order to control the resistivity of the intermediate transfer belt. There are no particular limitations on the conducting agent. For example, usable are one or more agents selected from the group consisting of carbon powder, metal powders such as aluminum or nickel powder, metal oxides such as titanium oxide, and conductive polymeric compounds such as quaternary-ammonium-salt-containing polymethyl methacrylate, polyvinyl aniline, polyvinyl pyrrole, polydiacetylene, polyethyleneimine, boron-containing polymeric compounds, and polypyrrole.

A lubricant may also optionally be added in order to improve the lubricity of the intermediate transfer belt to improve its transfer performance. As the lubricant, usable is the same lubricant as that used in the elastic layer of the intermediate transfer drum.

An image forming method is described below with reference to FIG. 4, in which toner images of different colors are respectively formed in a plurality of image forming sections and they are transferred to the same transfer medium while superimposing them in order.

Figure 4:
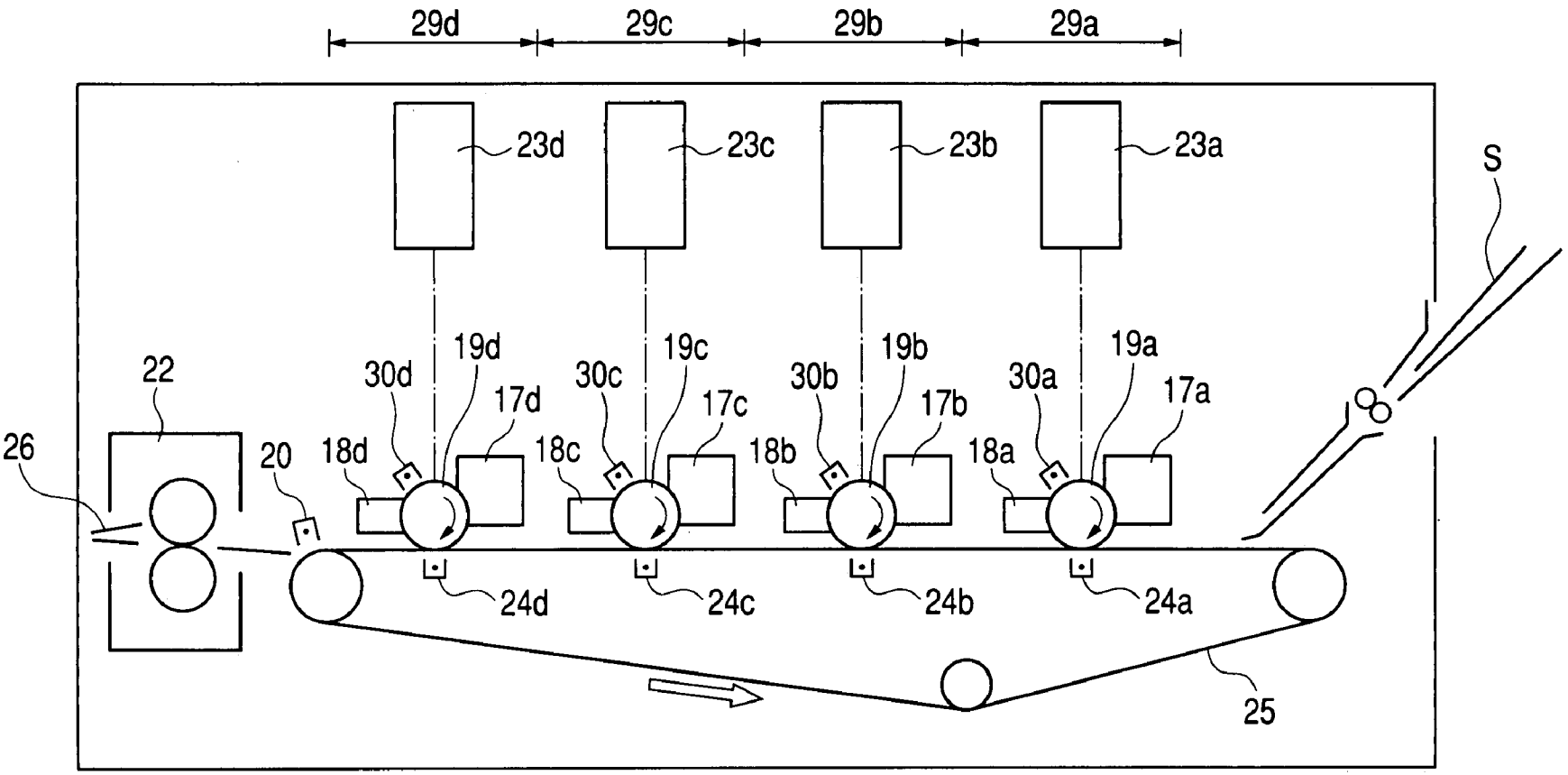
FIG. 4 is a schematic view showing an example of an image-forming method in which toner images of different colors are respectively formed in a plurality of image-forming sections and they are transferred to the same transfer medium while superimposing them in order.

In an image-forming apparatus shown in FIG. 4, first, second, third and fourth image forming sections 29*a*, 29*b*, 29*c* and 29*d* are arranged side by side, and the image forming sections have latent image bearing members used exclusively therein, i.e., photosensitive drums 19*a*, 19*b*, 19*c* and 19*d*, respectively.

The photosensitive drums 19*a* to 19*d* are provided around their peripheries with charging means 30*a*, 30*b*, 30*c* and 30*d*, latent image forming means 23*a*, 23*b*, 23*c* and 23*d*, developing means 17*a*, 17*b*, 17*c* and 17*d*, transfer means (transfer discharging means) 24*a*, 24*b*, 24*c* and 24*d*, and cleaning means 18*a*, 18*b*, 18*c* and 18*d*, respectively.

Under such constitution, first, the photosensitive drum 19*a* of the first image forming section 29*a* is electrostatically charged by a charging means 30, and a latent image of a color in the image of an original, e.g., a yellow component color latent image is formed thereon by the latent image forming means 23*a*. This latent image is converted into a visible image (toner image) by the use of a developer having a yellow toner, of the developing means 17*a*, and the toner image is transferred to a transfer medium S, a recording medium, by means of the transfer means 24*a*.

In the course the yellow toner image is transferred to the transfer medium S as described above, in the second image forming section 29*b* a magenta component color latent image is formed on the photosensitive drum 19*b*, and is subsequently converted into a visible image by the use of a developer having a magenta toner, of the developing means 17*b*. This visible image (magenta toner image) is superimposingly transferred to a preset position of the transfer medium S when the transfer medium S on which the transfer in the first image forming section 29*a* has been completed is transported to the transfer means 24*b*.

Subsequently, in the same manner as described above, cyan-color and black-color toner images are formed in the third and fourth image forming sections 29*c* and 29*d*, respectively, and the cyan-color and black-color toner images are superimposingly transferred to the same transfer medium S. Upon completion of such an image forming process, the transfer medium S is transported to a fixing section 22, where the toner images on the transfer medium S are fixed. Thus, a multi-color image is obtained on the transfer medium S. The respective photosensitive drums 19*a*, 19*b*, 19*c* and 19*d* on which the transfer has been completed are cleaned by the cleaning means 18*a*, 18*b*, 18*c* and 18*d*, respectively, to remove the residual toner, and subsequently a series of image formation process is repeated.

In the above image forming apparatus, a transport belt 25 is used to transport the transfer medium S, a recording medium.

In this image-forming apparatus, as a transport means for transporting the transfer medium, a transport belt making use of a mesh made of TETORON (registered trademark) fiber and a transport belt making use of a thin dielectric sheet made of a polyethylene terephthalate resin, a polyimide resin or a urethane resin may preferably be used from the viewpoint of readiness in working and durability.

In general, such a transfer belt has so high volume resistivity that the transport belt may increase in its charge quantity in the course the transfer is repeated several times in color image formation. Hence, in order to maintain uniform transfer, it is necessary to make transfer electric currents greater successively at every transfer. However, since the toner of the present invention has so good transfer performance that the transfer performance of the toner at every transfer can be made uniform under the like transfer electric currents even if the charging of the charging means has increased at every repetition of transfer, so that images with a good quality and a high quality level can be obtained.

After the transfer medium S has passed through the fourth image forming section 29*d*, an AC voltage is applied to a charge eliminator 20, whereupon the transfer medium S is destaticized, separated from the belt 25, thereafter sent into a fixing assembly 22 where the toner images are fixed, and finally sent out through a paper outlet 26.

Figure 5:
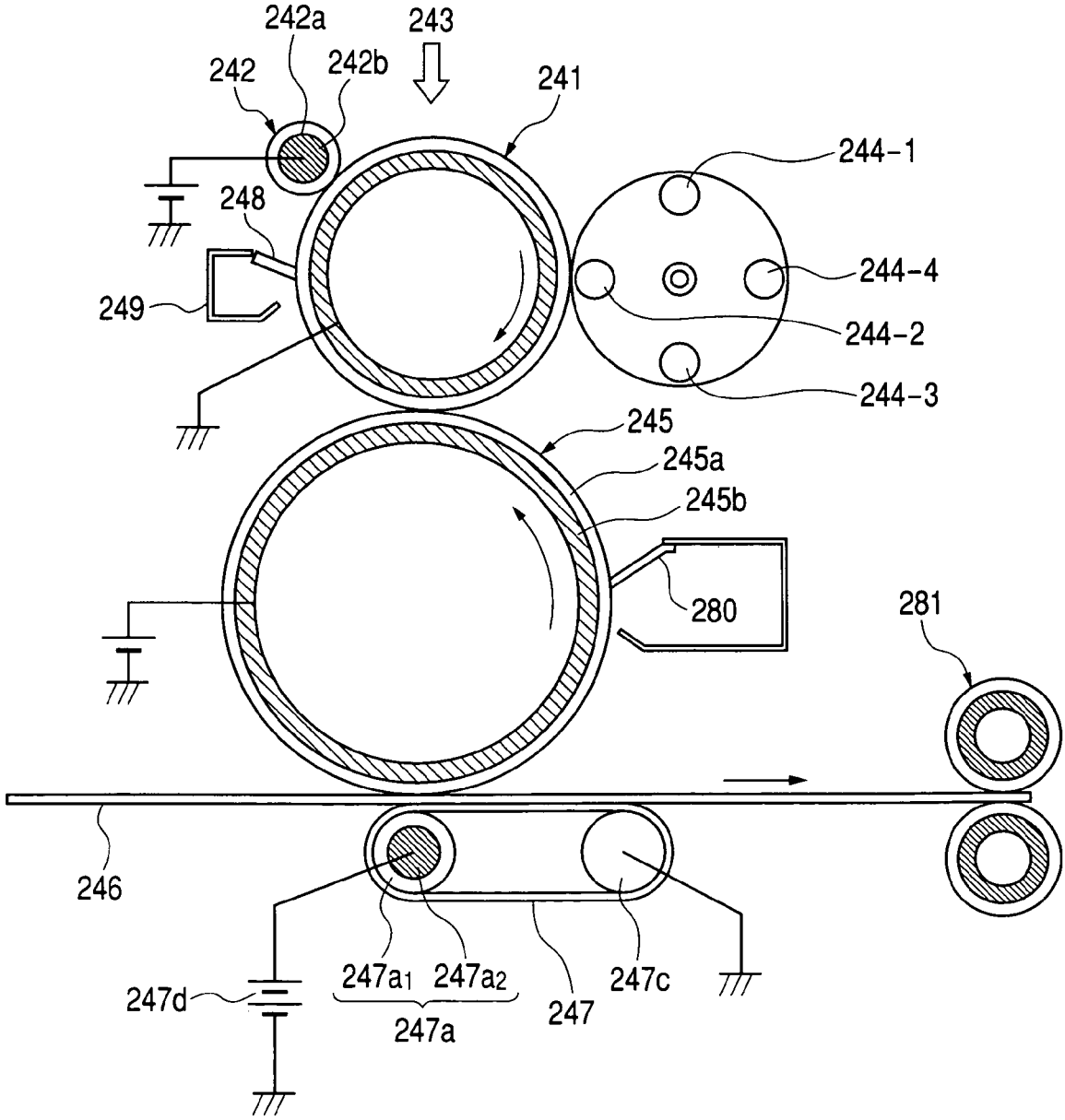
FIG. 5 is a schematic view showing an example of an image-forming apparatus in which four-color toner images primarily transferred to an intermediate transfer drum is one-time transferred to a transfer medium by the use of an intermediate transfer drum.

FIG. 5 illustrates an image-forming apparatus employing a transfer belt as a secondary transfer means when four-color toner images primarily transferred to an intermediate transfer drum is one-time transferred to a recording medium by the use of an intermediate transfer drum.

In the apparatus system shown in FIG. 5, a developer having a cyan toner, a developer having a magenta toner, a developer having a yellow toner and a developer having a black toner are put into developing assemblies 244-1, 244-2, 244-3 and 244-4, respectively. A photosensitive member 241 is electrostatically charged by a charging means, and is further exposed to light 243 to form electrostatic latent images on the photosensitive member 241. Then, the electrostatic latent images are developed by means of the developing assemblies 244-1 to 244-4 to form toner images of respective colors on the photosensitive member 241. The photosensitive member 241 is a photosensitive drum or photosensitive belt having a photoconductive insulating material layer formed of a-Se, CdS, $ZnO_2$, OPC or a-Si. The photosensitive member 241 is rotatingly driven in the direction of an arrow by means of a drive system (not shown).

In the step of charging, a charging roller 242 is used which is constituted basically of a mandrel 242*b* at the center and a conductive elastic layer 242*a* that forms the periphery of the former. The charging roller 242 is brought into pressure contact with the surface of the photosensitive member 241 under pressing force and is rotated followingly as the photosensitive member 241 is rotated.

The toner images on the photosensitive member 241 are transferred to an intermediate transfer drum 245 to which a voltage (e.g., plus-minus 0.1 to plus-minus 5 kV) is kept applied. The surface of the photosensitive member 241 after transfer is cleaned by a cleaning means 249 having a cleaning blade 248.

As the intermediate transfer drum 245, the same intermediate transfer drum as that described previously may be used. Here, reference numeral 245*b* denotes a rigid-body conductive support; and 245*a*, an elastic layer which covers the former.

The intermediate transfer drum 245 is provided in contact with the bottom part of the photosensitive member 241, being axially supported in parallel to the photosensitive member 241, and is rotatingly driven at the same peripheral speed as the photosensitive member 241 in the anti-clockwise direction as shown by an arrow.

The first-color cyan toner image formed and held on the surface of the photosensitive member 241 is, in the course where it is passed through the transfer nip portion where the photosensitive member 241 and the intermediate transfer drum 245 come into contact, transferred intermediately sequencially to the periphery of the intermediate transfer drum 245 by the aid of the electric filed formed at the transfer nip zone by a transfer bias applied to the intermediate transfer drum 245.

If necessary, after the toner images have been transferred to the transfer medium, the surface of the intermediate transfer drum 245 may be cleaned by a cleaning means 280 which can come in contact with or separate from it. When the toner image(s) is/are present on the intermediate transfer drum 245, the cleaning means 280 is separated from the surface of the intermediate transfer drum so that the toner image(s) is/are not disturbed.

As shown in FIG. 5, a transfer belt 247 is provided beneath the intermediate transfer drum 245. The transfer belt 247 is stretched over two rollers provided in parallel to the axis of the intermediate transfer drum 245, i.e., a bias roller 247*a* and a tension roller 247*c*, and is driven by a drive means (not shown). The transfer belt 247 is so constructed as to be movable in the directions of an arrow on the side of the bias roller 247*a* around the tension roller 247*c* so that it can come in contact with or separate from the intermediate transfer drum 245 upward or downward in the direction of the arrow. To the bias roller 247*a*, a desired secondary transfer bias is kept applied by a secondary transfer bias source 247*d*. As for the tension roller 247*c*, it is grounded.

Then, with regard to the transfer belt 247, used in the present embodiment is a rubber belt comprising a thermosetting urethane elastomer in which carbon has been dispersed (thickness: about 300 μm; volume resistivity: $10^8$ to $10^{12}$ Ω·cm at the time of application of 1 kV) and the surface of which is further covered with a fluororubber layer (thickness: 20 μm; volume resistivity: $10^{15}$ Ω·cm at the time of application of 1 kV). It has the shape of a tube of 80 mm in peripheral length and 300 mm in width as external size.

The transfer belt 247 described above is elongated by about 5% by tension applied by the aid of the bias roller 247*a* and tension roller 247*c*.

The transfer belt 247 is rotated at a speed equal to, or made different from, the peripheral speed of the intermediate transfer drum 245. The transfer medium 246 is transported to the part between the intermediate transfer drum 245 and the transfer belt 247 and simultaneously a bias with a polarity reverse to triboelectric charges the toners have is applied to the transfer belt 247 from a transfer bias source 247*d*, so that the toner images on the intermediate transfer drum 245 are transferred to the surface side of the transfer medium 246.

The bias roller may be made of the same material as that for the charging roller. The transfer process may preferably be performed under conditions of a roller contact pressure of 4.9 to 490 N/m (5 to 500 gf/cm) and a DC voltage of plus-minus 0.2 to plus-minus 10 kV.

A conductive elastic layer 247*a*1 of the bias roller 247*a* is made of, e.g., an elastic material having a volume resistivity of $10^6$ to $10^{10}$ Ω·cm, such as a polyurethane, or an ethylene-propylene-diene type terpolymer (EPDM), with a conductive material such as carbon dispersed therein. A bias is kept applied to a mandrel 247*a*2 by a constant voltage power source. As bias conditions, a voltage of from plus-minus 0.2 to plus-minus 10 kV is preferred.

Subsequently, the transfer medium 246 is transported to a fixing assembly 281 constituted basically of a heat roller provided internally with a heating element such as a halogen heater and an elastic material pressure roller brought into contact therewith under pressing force, and is passed between the heat roller and the pressure roller, thus the toner images are heat-and-pressure fixed to the transfer medium. Another method may also be used in which the toner images are fixed by a heater through a film.

EXAMPLES

The present invention is described below in greater detail by giving production examples and working examples, which, however, by no means limit the present invention. In the following formulation, "part(s)" refers to "part(s) by weight" in all occurrences.

Production Example of Polar Polymer (Resin Having Sulfur Atoms) 1

Into a pressurizable reaction vessel having a reflux tube, a stirrer, a thermometer, a nitrogen feed pipe, a dropping unit and an evacuation unit, 250 parts of methanol, 150 parts of 2-butanone and 100 parts of 2-propanol as solvents and 85 parts of styrene, 11 parts of 2-ethylhexyl acrylate and 4 parts of 2-acrylamido-2-methylpropanesulfonic acid as monomers were introduced, and then heated to reflux temperature with stirring. A solution prepared by diluting 1 part of a polymerization initiator t-butyl peroxy-2-ethylhexanoate with 20 parts of 2-butanone was dropwise added thereto over a period of 30 minutes, and the stirring was continued for 5 hours, to which a solution prepared by diluting 1 part of t-butyl peroxy-2-ethylhexanoate with 20 parts of 2-butanone was further dropwise added over a period of 30 minutes, followed by stirring for further 5 hours to complete polymerization.

Next, a polymer obtained after the polymerization solvents were removed under reduced pressure was pulverized to a size of 100 μm or less by means of a cutter mill fitted with a 150-mesh screen. The polar polymer thus obtained had a Tg of about 75° C., an Mw of 28,000, an Mn of 12,000, a main-peak molecular weight (Mp) of 15,000 and an acid value of 12.5. Its composition measured by $^1$H-NMR (EX-400, manufactured by Nippon Denshi K.K.; 400 MHz) was found to accord with the quantities of materials loaded. The polar polymer obtained is designated as Polar Polymer 1.

Example 1

First, a polymerization toner was produced by the following procedure. To 900 parts of ion-exchanged water heated to 60° C., 3 parts of tricalcium phosphate was added, followed by stirring at 10,000 rpm by means of a TK-type homomixer (manufactured by Tokushu Kika Kogyo Co., Ltd.) to prepare an aqueous medium.

The following polymerization monomer composition was also introduced into a TK-type homomixer (manufactured by Tokushu Kika Kogyo Co., Ltd.), and then heated to 60° C., followed by stirring at 9,000 rpm to effect dispersion and dissolution.

| | |
|---|---|
| Styrene | 160 parts |
| n-Butyl acrylate | 40 parts |
| C.I. Pigment Blue 15:3 | 14 parts |
| Polar Polymer 1 | 1.5 parts |
| Polyester resin (a polycondensation product of propylene oxide modified bisphenol A and isophthalic acid; Tg: 65° C.; Mw: 10,000; Mn: 6,000) | 10 parts |
| Stearyl stearate wax (DSC main peak: 60° C.) | 30 parts |
| Divinylbenzene | 0.5 part |
| Di-t-butyl ether | 0.04 part |

In the mixture formed, 5 parts of a polymerization initiator 2,2'-azobis(2,4-dimethylvaleronitrile) was dissolved to prepare a polymerizable monomer composition.

The polymerizable monomer composition was introduced into the above aqueous medium, followed by stirring at 60° C. in an atmosphere of nitrogen, using the TK-type homomixer at 8,000 rpm to granulate the polymerizable monomer composition.

Thereafter, the granulated product obtained was moved to a propeller stirrer and stirred, during which the temperature was raised to 70° C. over a period of 2 hours. Four hours later, the temperature was further raised to 80° C. at a rate of heating of 40° C./hr, where the reaction was carried out at 80° C. for 5 hours to produce polymer particles. After the polymerization was completed, a slurry containing the particles was cooled, which was then washed with water used in an amount 10 times that of the slurry, followed by filtration, drying, and thereafter classification to control particle diameter to obtain cyan toner particles.

In 100 parts of the cyan toner particles thus obtained, 1.5 parts of hydrophobic fine silica powder (primary particle diameter: 10 nm: BET specific surface area: 170 $m^2/g$) having been treated with silicone oil and being chargeable to the same polarity (negative polarity) as that of the toner particles was mixed as a fluidity improver for 5 minutes by means of a Henschel mixer (manufactured by Mitsui Miike Engineering Corporation) to obtain Toner (1) of the present invention.

Toner (1) had a weight-average particle diameter of 6.8 μm and an average circularity of 0.985.

In regard to Toner (1), the content of the ether compound according to the present invention was measured by gas chromatography to find that in Toner (1) the di-t-butyl ether was in a content of 150 ppm.

The liberation percentage of the inorganic fine powder was also measured with a particle analyzer, and the ratio of carbon atom content and sulfur atom content at toner particle surface portions was determined by ESCA. Values of physical properties of the toner are shown in Table 1.

Figure 6:
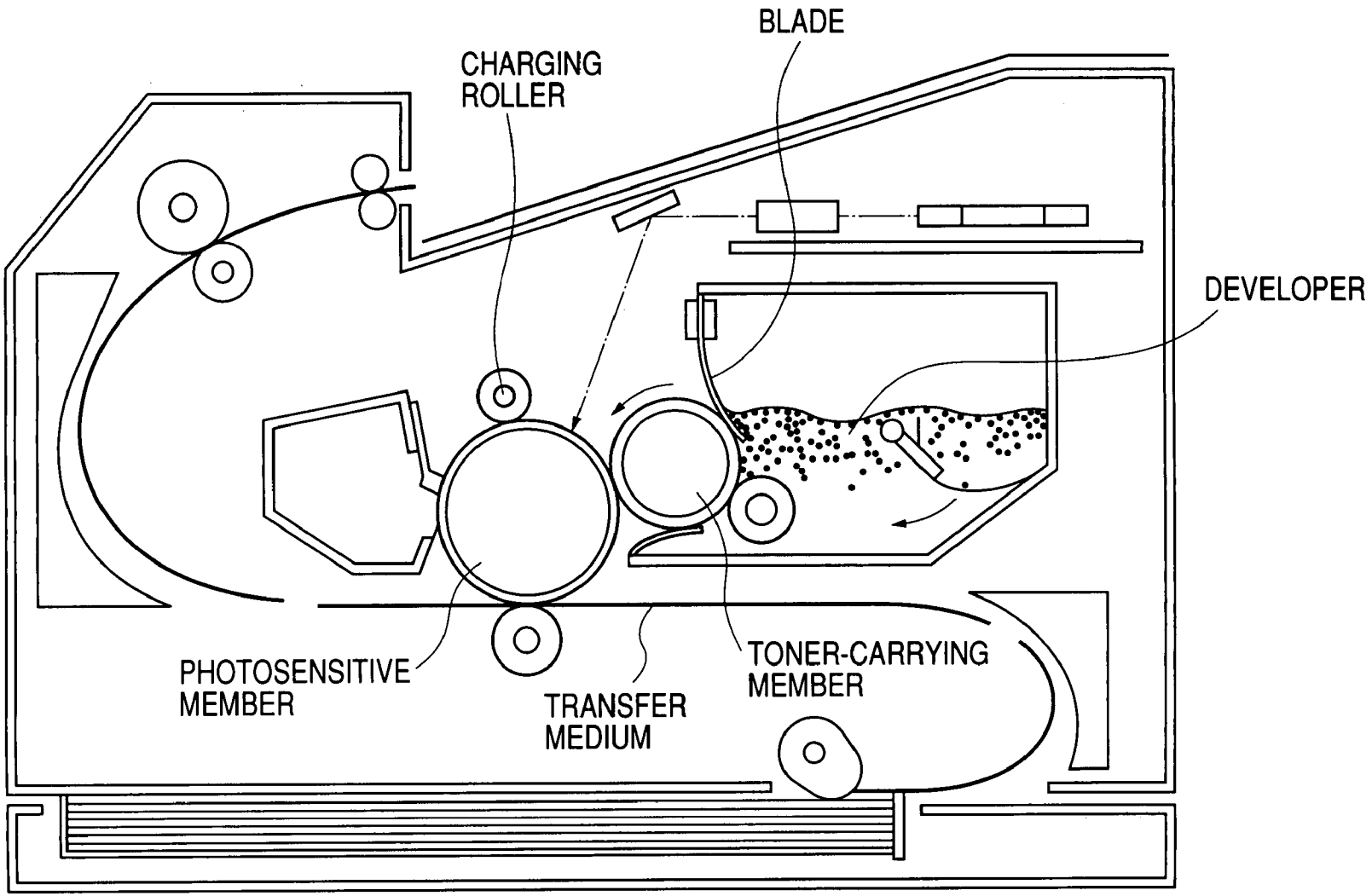
FIG. 6 is a schematic view showing an example of an image-forming apparatus used in Examples.

Toner (1) was used as a non-magnetic one-component developer, and images were formed using an image-forming apparatus like that shown in FIG. 6, to make evaluation. This image-forming apparatus is described below.

FIG. 6 is a schematic view of a remodeled machine of a 1,200 dpi laser beam printer (LBP-840, manufactured by CANON INC.), which utilizes an electrophotographic process of a non-magnetic one-component developing system. In this Example, used was an apparatus remodeled on the following items (a) to (h).

(a) The charging system of this apparatus was changed to direct charging carried out by bringing a rubber roller into contact. A voltage of a DC component (−1,200 V) was applied.

(b) The toner-carrying member was changed to a medium-resistance rubber roller (diameter: 16 mm; hardness: ASKER-C 45 degrees; resistivity: $10^5$ Ω·cm) composed of silicone rubber with carbon black dispersed therein, and was brought into contact with the photosensitive member.

(c) The toner carrying member was so driven as to be rotated in the same direction as the photosensitive member at the former's part coming into contact with the latter and at a peripheral speed of 145% with respect to the rotational peripheral speed of the photosensitive member.

(d) The photosensitive member was changed to the following.

As a photosensitive member used here, an aluminum cylinder was used as a substrate and layers constituted as shown below were formed in layers thereon in order by dip coating to produce the photosensitive member.

Conductive coating layer: Composed chiefly of powders of tin oxide and titanium oxide dispersed in phenol resin. Layer thickness: 15 μm.

Subbing layer: Composed chiefly of a modified nylon and a copolymer nylon. Layer thickness: 0.6 μm.

Charge generation layer: Composed chiefly of a titanyl phthalocyanine pigment having absorption in a long wavelength range, dispersed in butyral resin. Layer thickness: 0.6 μm.

Charge transport layer: Composed chiefly of a hole-transporting triphenylamine compound dissolved in a polycarbonate resin (molecular weight: 20,000 as measured by Ostwald viscometry) in weight ratio of 8:10. Layer thickness: 20 μm.

(e) As a means for coating the toner on the toner carrying member, a coating roller composed of a foamed urethane rubber was provided in the developing assembly and was brought into contact with the toner carrying member. A voltage of about −550 V was applied to the coating roller.

(f) For the purpose of coat layer control of the toner on the toner carrying member, a resin-coated blade made of stainless steel was used.

(g) The voltage applied at the time of development was only a DC component (−450 V).

A rubber roller having the same diameter, the same hardness and the same resistivity as those of the toner-carrying member used in this image-forming apparatus was very thin coated on its surface with a commercially available coating material, and was provisionally set in the image-forming apparatus. Thereafter, the rubber roller was detached, and the surface of the stainless steel blade (to which the coating material on the roller stood transferred) was observed with an optical microscope to measure the NE length. The NE length was 1.05 mm.

To make adaptation to such remodeling, the image-forming apparatus was remodeled and its process conditioned were set as described below.

The remodeled apparatus has a process comprising charging the image bearing member electrostatically by means of a roller charging assembly (only a DC current is applied), subsequently to the charging, exposing image areas to laser light to form an electrostatic latent image, making the latent image into a visible image (toner image) by the use of the toner, and thereafter transferring the toner image to a recording medium by means of a roller to which a voltage of +700 V is kept applied.

The photosensitive member was set to have a dark-area potential of −600 V and a light-area potential of −150 V.

Under the above conditions, images with a print percentage of 2% were printed on up to 5,000 sheets in an environment of high temperature and high humidity (30° C., 80% RH), an environment of normal temperature and normal humidity (23° C., 50% RH) and an environment of low temperature and low humidity (15° C., 10% RH) and at a two-sheet intermittent mode (i.e., a mode in which the developing assembly was made to pause for 10 seconds every time the images were printed on two sheets and the deterioration of the toner was accelerated by preliminary operation of the developing assembly when again driven). Thereafter, the level of fog on drum was evaluated by the method described layer.

As evaluation of image quality, evaluation was also made on image density and fog in the following way. The results of evaluation are shown in Table 2.

(1) Image Density:

Conventional copying plane paper (75 $g/m^2$ in basis weight) was used as transfer mediums, and solid images were reproduced at the initial stage and at the time the running evaluation was completed in the image reproduction test. Density of the images formed was measured to make evaluation. Here, the image density was measured with MACBETH REFLECTION DENSITOMETER RD918 (manufactured by Macbeth Co.), as relative density with respect to an image printed on a white background area with a density of 0.00 of an original.

A: Very good; 1.40 or more.

B: Good; from 1.35 or more to less than 1.40.

C: No problem in practical use; from 1.00 or more to less than 1.35.

D: A little problematic; less than 1.00.

(2) Image Fog:

Fog density (%) was calculated from a difference between the whiteness at a white background area of images printed and the whiteness of the transfer medium which were measured with REFLECTOMETER MODEL TC-6DS (manufactured by Tokyo Denshoku Co., Ltd.) to make evaluation on image fog at the time the running evaluation was completed. As filters, an amber light filter was used in the case of a cyan toner, a blue filter in the case of a yellow toner, and green filters in the cases of magenta and black toners.

A: Very good; 0.5% or less.

B: Good; from 0.5% or more to less than 1.0%.

C: No problem in practical use; from 1.0% or more to less than 1.5%.

D: A little problematic; more than 1.5%.

(3) Maximum Fog on Photosensitive Member:

For the purpose of evaluating charge quantity distribution, the drum (photosensitive member) was forcedly stopped in the course that solid white images were printed by changing the applied voltage at the time of development to change the back contrast to 50 V to 250 V. Fog on the drum at that point was gathered with a Mylar tape, and this was stuck to white paper, where a difference between the maximum fog density (%) measured when the fog density (%) was measured in the same manner as the above item (2) and the fog density (%) measured when only Mylar tape was stuck to white paper was defined to be the maximum fog on photosensitive member. The fog density at this point was measured in the same manner as in the above item (2).

A: Very good; less than 1.0%.

B: Good; from 1.0% or more to less than 2.0%.

C: No problem in practical use; from 2.0% or more to less than 5.0%.

D: A little problematic; 5.0% or more, or a case in which clear faulty cleaning was seen to have occurred.

(4) Contamination of Charging Roller:

As evaluation on member contamination due to liberated external additives, the state of contamination of the charging roller was visually evaluated.

A: Very good; not contaminated at all.

B: Good; external additives are seen to have adhered to the surface of the charging roller, but any faulty images corresponding thereto are not observable on halftone images.

C: No problem in practical use; external additives are seen to have adhered to the surface of the charging roller, and faulty images corresponding to such contamination are slightly seen on halftone images, but not seen on solid white images.

D: A little problematic; external additives are seen to have adhered to the surface of the charging roller, and faulty images corresponding to such contamination are seen also on solid white images.

Example 2

Toner (2) was produced in the same manner as in Example 1 except that the di-t-butyl ether was not added and 8 parts of t-butyl peroxypivarate (PERBUTYL PV, available from Nippon Oil & Fats Co., Ltd.) was used as the polymerization initiator. In this Example, 350 ppm of di-t-butyl ether was found to have been formed upon the reaction during polymerization. This compound was determined by mass spectrometry.

Physical properties of Toner (2) are shown in Table 1, and the results of evaluation made in the same manner as in Example 1 in Table 2.

Example 3

Toner (3) was produced in the same manner as in Example 1 except that the ether compound to be added was changed for isobutyl-t-butyl ether.

In regard to Toner (3), the content of the ether compound according to the present invention was measured by gas chromatography to find that in Toner (3) the isobutyl-t-butyl ether was in a content of 150 ppm. Physical properties of Toner (3) are shown in Table 1, and the results of evaluation made in the same manner as in Example 1 in Table 2.

Example 4

Toner (4) was produced in the same manner as in Example 1 except that the ether compound to be added was changed for isobutyl-t-butyl ether and it was added in an amount changed to 0.006 part.

In regard to Toner (4), the content of the ether compound according to the present invention was measured by gas chromatography to find that in Toner (4) the isobutyl-t-butyl ether was in a content of 20 ppm. Physical properties of Toner (4) are shown in Table 1, and the results of evaluation made in the same manner as in Example 1 in Table 2.

Example 5

Toner (5) was produced in the same manner as in Example 1 except that the di-t-butyl ether to be added was added in an amount changed to 0.003 part.

In regard to Toner (5), the content of the ether compound according to the present invention was measured by gas chromatography to find that in Toner (5) the di-t-butyl ether was in a content of 8 ppm. Physical properties of Toner (5) are shown in Table 1, and the results of evaluation made in the same manner as in Example 1 in Table 2.

Example 6

Toner (6) was produced in the same manner as in Example 1 except that the ether compound to be added was changed for isobutyl-t-heptyl ether having the following structure and it was added in an amount changed to 0.17 part.

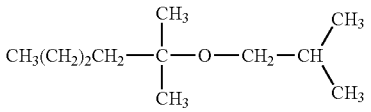

In regard to Toner (6), the content of the ether compound according to the present invention was measured by gas chromatography to find that in Toner (6) the ether compound having the above structure was in a content of 650 ppm. Physical properties of Toner (6) are shown in Table 1, and the results of evaluation made in the same manner as in Example 1 in Table 2.

Example 7

Toner (7) was produced in the same manner as in Example 1 except that the di-t-butyl ether to be added was added in an amount changed to 0.23 part.

In regard to Toner (7), the content of the ether compound according to the present invention was measured by gas chromatography to find that in Toner (7) the di-t-butyl ether was in a content of 900 ppm. Physical properties of Toner (7) are shown in Table 1, and the results of evaluation made in the same manner as in Example 1 in Table 2.

Example 8

Toner (8) was produced in the same manner as in Example 1 except that the ether compound to be added was changed for a compound of the following structural formula and it was added in an amount changed to 0.20 part.

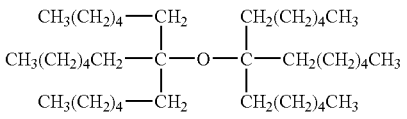

In regard to Toner (8), the content of the ether compound according to the present invention was measured by gas chromatography to find that in Toner (8) the ether compound having the above structure was in a content of 770 ppm. Physical properties of Toner (8) are shown in Table 1, and the results of evaluation made in the same manner as in Example 1 in Table 2.

Example 9

Toner (9) was produced in the same manner as in Example 1 except that the polymerization temperature 70° C. at the initial stage was changed to 75° C.

In regard to Toner (9), the content of the ether compound according to the present invention was measured by gas chromatography to find that in Toner (9) the di-t-butyl ether was in a content of 160 ppm. Physical properties of Toner (9) are shown in Table 1, and the results of evaluation made in the same manner as in Example 1 in Table 2.

Example 10

Styrene/n-butyl Acrylate Copolymer (Weight Ratio:

| | |
|---|---|
| 78/22; Mn: 24,300; Mw/Mn: 3.0) | 200 parts |
| C.I. Pigment Blue 15:3 | 14 parts |
| Polar Polymer 1 | 1.5 parts |
| Polyester resin (a polycondensation product of propylene oxide modified bisphenol A and isophthalic acid; Tg: 65° C.; Mw: 10,000; Mn: 6,000) | 10 parts |
| Stearyl stearate wax (DSC main peak: 60° C.) | 10 parts |
| Di-t-butyl ether | 0.1 part |

The above materials were mixed by means of a blender, and the mixture obtained was melt-kneaded by means of a twin-screw extruder heated to 110° C. The resulting melt-kneaded product, having been cooled, was crushed using a hammer mill, and the crushed product obtained was finely pulverized by means of an impact jet mill (manufactured by Nippon Pneumatic Industries Co.). The finely pulverized product obtained was subjected to air classification to obtain toner particles (10) with a weight-average particle diameter of 11.2 μm.

To 100 parts of the toner particles thus obtained, 1.2 parts of the same hydrophobic fine silica powder as that used in Example 1 was added, and the resultant mixture was mixed by means of a Henschel mixer to obtain Toner (10).

Toner (10) had a weight-average particle diameter of 11.2 μm and an average circularity of 0.930.

In regard to Toner (10), the content of the ether compound according to the present invention was measured by gas chromatography to find that in Toner (10) the di-t-butyl ether was in a content of 150 ppm. Physical properties of Toner (10) are shown in Table 1, and the results of evaluation made in the same manner as in Example 1 in Table 2.

Example 11

Toner (11) was produced in the same manner as in Example 1 except that the polar polymer 1 was not added.

In regard to Toner (11), the content of the ether compound according to the present invention was measured by gas chromatography to find that in Toner (11) the di-t-butyl ether was in a content of 150 ppm. Physical properties of Toner (11) are shown in Table 1, and the results of evaluation made in the same manner as in Example 1 in Table 2.

Example 12

Toner (12) was produced in the same manner as in Example 1 except that in place of Polar Polymer 1 a salicylic acid aluminum compound (BONTRON E-88, available from Orient Chemical Industries, Ltd.) was used in an amount of 3 parts.

In regard to Toner (12), the content of the ether compound according to the present invention was measured by gas chromatography to find that in Toner (12) the di-t-butyl ether was in a content of 150 ppm. Physical properties of Toner (12) are shown in Table 1, and the results of evaluation made in the same manner as in Example 1 in Table 2.

Example 13

Toner (13) was produced in the same manner as in Example 1 except that Polar Polymer 1 was added in an amount changed to 0.15 part.

In regard to Toner (13), the content of the ether compound according to the present invention was measured by gas chromatography to find that in Toner (13) the di-t-butyl ether was in a content of 150 ppm. Physical properties of Toner (13) are shown in Table 1, and the results of evaluation made in the same manner as in Example 1 in Table 2.

Example 14

Toner (14) was produced in the same manner as in Example 1 except that Polar Polymer 1 was added in an amount changed to 5 parts.

In regard to Toner (14), the content of the ether compound according to the present invention was measured by gas chromatography to find that in Toner (14) the di-t-butyl ether was in a content of 150 ppm. Physical properties of Toner (14) are shown in Table 1, and the results of evaluation made in the same manner as in Example 1 in Table 2.

Example 15

Toner (15) was produced in the same manner as in Example 1 except that fine anatase type titanium oxide powder (average primary particle diameter: 40 nm) was further added as an external additive in addition to the fine silica powder.

In regard to Toner (15), the content of the ether compound according to the present invention was measured by gas chromatography to find that in Toner (15) the di-t-butyl ether was in a content of 150 ppm. Physical properties of Toner (15) are shown in Table 1, and the results of evaluation made in the same manner as in Example 1 in Table 2. Here, the liberation percentage of the inorganic fine powder was calculated from the liberation percentage found from silicon atoms and titanium atoms.

Example 16

Toner (16) was produced in the same manner as in Example 1 except that fine aluminum oxide powder (average primary particle diameter: 40 nm) was further added as an external additive in addition to the fine silica powder.

In regard to Toner (16), the content of the ether compound according to the present invention was measured by gas chromatography to find that in Toner (16) the di-t-butyl ether was in a content of 150 ppm. Physical properties of Toner (16) are shown in Table 1, and the results of evaluation made in the same manner as in Example 1 in Table 2. Here, the liberation percentage of the inorganic fine powder was calculated from the liberation percentage found from silicon atoms and aluminum atoms.

Example 17

Toner (17) was produced in the same manner as in Example 1 except the external additive fine silica powder was changed for fine silica powder having an average primary particle diameter of 5 nm and also it was added in an amount changed to 1.3 parts.

In regard to Toner (17), the content of the ether compound according to the present invention was measured by gas chromatography to find that in Toner (17) the di-t-butyl ether was in a content of 150 ppm. Physical properties of Toner (17) are shown in Table 1, and the results of evaluation made in the same manner as in Example 1 in Table 2.

Example 18

Toner (18) was produced in the same manner as in Example 1 except that fine silica powder having a larger particle diameter (average primary particle diameter: 60 nm) was further added as an external additire in addition to the fine silica powder used in Example 1.

In regard to Toner (18), the content of the ether compound according to the present invention was measured by gas chromatography to find that in Toner (18) the di-t-butyl ether was in a content of 150 ppm. Physical properties of Toner (18) are shown in Table 1, and the results of evaluation made in the same manner as in Example 1 in Table 2.

Example 19

Toner (19) was produced in the same manner as in Example 1 except that the time of mixing the external additive was changed to 2 minutes and 30 seconds.

In regard to Toner (19), the content of the ether compound according to the present invention was measured by gas chromatography to find that in Toner (19) the di-t-butyl ether was in a content of 150 ppm. Physical properties of Toner (19) are shown in Table 1, and the results of evaluation made in the same manner as in Example 1 in Table 2.

Example 20

Toner (20) was produced in the same manner as in Example 1 except that the time of mixing the external additive was changed to 1 minute and 15 seconds.

In regard to Toner (20), the content of the ether compound according to the present invention was measured by gas chromatography to find that in Toner (20) the di-t-butyl ether was in a content of 150 ppm. Physical properties of Toner (20) are shown in Table 1, and the results of evaluation made in the same manner as in Example 1 in Table 2.

Example 21

Toner (21) was produced in the same manner as in Example 15 except that the time of mixing the external additive was changed to 1 minute and 15 seconds.

In regard to Toner (21), the content of the ether compound according to the present invention was measured by gas chromatography to find that in Toner (21) the di-t-butyl ether was in a content of 150 ppm. Physical properties of Toner (21) are shown in Table 1, and the results of evaluation made in the same manner as in Example 1 in Table 2.

Example 22

Toner (22) was produced in the same manner as in Example 16 except that the time of mixing the external additive was changed to 1 minute and 15 seconds.

In regard to Toner (22), the content of the ether compound according to the present invention was measured by gas chromatography to find that in Toner (22) the di-t-butyl ether was in a content of 150 ppm. Physical properties of Toner (22) are shown in Table 1, and the results of evaluation made in the same manner as in Example 1 in Table 2.

Example 23

In 100 parts of the cyan toner particles of Example 1, 1.5 parts of hydrophobic fine silica powder (primary particle diameter: 10 nm: BET specific surface area: 160 $m^2/g$) having been treated with hexamethyldisilazane and thereafter treated with silicone oil was mixed as a fluidity improver for 5 minutes by means of a Henschel mixer (manufactured by Mitsui Miike Engineering Corporation) to obtain Toner (23).

In regard to Toner (23), the content of the ether compound according to the present invention was measured by gas chromatography to find that in Toner (23) the di-t-butyl ether was in a content of 150 ppm. Physical properties of Toner (23) are shown in Table 1, and the results of evaluation made in the same manner as in Example 1 in Table 2.

Example 24

In 100 parts of the cyan toner particles of Example 1, 1.5 parts of hydrophobic fine silica powder (primary particle diameter: 10 nm: BET specific surface area: 180 $m^2/g$) having been treated with hexamethyldisilazane was mixed as a fluidity improver for 5 minutes by means of a Henschel mixer (manufactured by Mitsui Miike Engineering Corporation) to obtain Toner (24).

In regard to Toner (24), the content of the ether compound according to the present invention was measured by gas chromatography to find that in Toner (24) the di-t-butyl ether was in a content of 150 ppm. Physical properties of Toner

(24) are shown in Table 1, and the results of evaluation made in the same manner as in Example 1 in Table 2.

Example 25

Toner (25) was produced in the same manner as in Example 1 except that 1.5 parts of fine silica powder AEROSIL #200 (available from Nippon Aerosil Co., Ltd.) was added as the fluidity improver.

In regard to Toner (25), the content of the ether compound according to the present invention was measured by gas chromatography to find that in Toner (25) the di-t-butyl ether was in a content of 150 ppm. Physical properties of Toner (25) are shown in Table 1, and the results of evaluation made in the same manner as in Example 1 in Table 2.

Example 26

Toner (26) was produced in the same manner as in Example 1 except that, in place of C.I. Pigment Blue 15:3 used in an amount of 14 parts, C.I. Pigment Yellow 17 was used as the colorant in an amount of 10 parts.

In regard to Toner (26), the content of the ether compound according to the present invention was measured by gas chromatography to find that in Toner (26) the di-t-butyl ether was in a content of 150 ppm. Physical properties of Toner (26) are shown in Table 1, and the results of evaluation made in the same manner as in Example 1 in Table 2.

Example 27

Toner (27) was produced in the same manner as in Example 1 except that, in place of C.I. Pigment Blue 15:3 used in an amount of 14 parts, C.I. Pigment Red 122 was used as the colorant in an amount of 16 parts.

In regard to Toner (27), the content of the ether compound according to the present invention was measured by gas chromatography to find that in Toner (27) the di-t-butyl ether was in a content of 150 ppm. Physical properties of Toner (27) are shown in Table 1, and the results of evaluation made in the same manner as in Example 1 in Table 2.

Example 28

Toner (28) was produced in the same manner as in Example 1 except that, in place of C.I. Pigment Blue 15:3 used in an amount of 14 parts, carbon black (DBP oil absorption: 42 $cm^3/100$ g; specific surface area: 60 $m^2/g$) was used as the colorant in an amount of 16 parts.

In regard to Toner (28), the content of the ether compound according to the present invention was measured by gas chromatography to find that in Toner (28) the di-t-butyl ether was in a content of 150 ppm. Physical properties of Toner (28) are shown in Table 1, and the results of evaluation made in the same manner as in Example 1 in Table 2.

Comparative Example 1

Toner (29) was produced in the same manner as in Example 20 except that the di-t-butyl ether was not added. Physical properties of Toner (29) are shown in Table 1, and the results of evaluation made in the same manner as in Example 1 in Table 2.

Comparative Example 2

Toner (30) was produced in the same manner as in Example 20 except that the di-t-butyl ether was changed for diethyl ether having the following structure.

$$CH_3CH_2—O—CH_2CH_3$$

In regard to Toner (30), the content of the ether compound was measured by gas chromatography to find that in Toner (30) the ether compound having the above structure was in a content of 150 ppm. Physical properties of Toner (30) are shown in Table 1, and the results of evaluation made in the same manner as in Example 1 in Table 2.

Comparative Example 3

Toner (31) was produced in the same manner as in Example 20 except that the di-t-butyl ether was changed for ethyl-2-octyldecyl ether having the following structure.

$$CH_3CH_2—O—CH_2—\underset{\underset{CH_2(CH_2)_6CH_3}{|}}{CH}—CH_2(CH_2)_6CH_3$$

In regard to Toner (31), the content of the ether compound was measured by gas chromatography to find that in Toner (31) the ether compound having the above structure was in a content of 150 ppm. Physical properties of Toner (31) are shown in Table 1, and the results of evaluation made in the same manner as in Example 1 in Table 2.

Comparative Example 4

Toner (32) was produced in the same manner as in Example 20 except that the di-t-butyl ether was changed for dodecyl-ethyl ether having the following structure.

$$CH_3CH_2—O—CH_2(CH_2)_{10}CH_3$$

In regard to Toner (32), the content of the ether compound was measured by gas chromatography to find that in Toner (32) the ether compound having the above structure was in a content of 150 ppm. Physical properties of Toner (32) are shown in Table 1, and the results of evaluation made in the same manner as in Example 1 in Table 2.

Comparative Example 5

Toner (33) was produced in the same manner as in Example 20 except that the di-t-butyl ether was changed for dodecyl-2-octyldecyl ether having the following structure.

$$CH_3(CH_2)_6CH_2—\underset{\underset{CH_2(CH_2)_6CH_3}{|}}{CH}—CH_2—O—CH_2(CH_2)_{10}CH_3$$

In regard to Toner (33), the content of the ether compound was measured by gas chromatography to find that in Toner (33) the ether compound having the above structure was in a content of 150 ppm. Physical properties of Toner (33) are shown in Table 1, and the results of evaluation made in the same manner as in Example 1 in Table 2.

Comparative Example 6

Toner (34) was produced in the same manner as in Example 20 except that the ether compound to be added was changed for a compound of the following structural formula and it was added in an amount changed to 0.52 part.

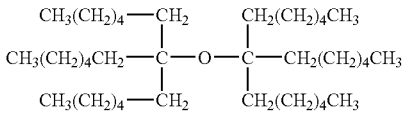

In regard to Toner (34), the content of the ether compound was measured by gas chromatography to find that in Toner (34) the ether compound having the above structure was in a content of 2,000 ppm. Physical properties of Toner (34) are shown in Table 1, and the results of evaluation made in the same manner as in Example 1 in Table 2.

TABLE 1

| | Ether compound content (ppm) | Weight = average particle diameter (μm) | Average circularity | Mode circularity | E/A | Inorganic fine powder liberation percentage (%) | $(C_E) - (C_S)$ |
|---|---|---|---|---|---|---|---|
| Example | | | | | | | |
| 1 | 150 | 6.8 | 0.985 | 1.00 | 0.0032 | 0.24 | 5 |
| 2 | 350 | 6.7 | 0.979 | 1.00 | 0.0031 | 0.25 | 5 |
| 3 | 150 | 6.8 | 0.985 | 1.00 | 0.0032 | 0.26 | 5 |
| 4 | 20 | 6.9 | 0.981 | 1.00 | 0.0034 | 0.16 | 5 |
| 5 | 8 | 6.9 | 0.979 | 1.00 | 0.0035 | 0.73 | 6 |
| 6 | 650 | 6.8 | 0.987 | 1.00 | 0.0030 | 0.63 | 6 |
| 7 | 900 | 6.9 | 0.987 | 1.00 | 0.0033 | 2.10 | 10 |
| 8 | 770 | 6.8 | 0.983 | 1.00 | 0.0032 | 2.05 | 18 |
| 9 | 160 | 9.0 | 0.950 | 1.00 | 0.0033 | 0.21 | 12 |
| 10 | 150 | 11.2 | 0.930 | 0.95 | 0.0018 | 0.31 | 51 |
| 11 | 150 | 6.6 | 0.979 | 1.00 | — | 1.00 | 10 |
| 12 | 150 | 7.0 | 0.984 | 1.00 | — | 0.81 | 8 |
| 13 | 150 | 6.5 | 0.981 | 1.00 | 0.0004 | 0.23 | 7 |
| 14 | 150 | 6.5 | 0.986 | 1.00 | 0.0054 | 3.88 | 7 |
| 15 | 150 | 6.5 | 0.982 | 1.00 | 0.0028 | 0.35 | 7 |
| 16 | 150 | 7.0 | 0.984 | 1.00 | 0.0030 | 0.49 | 7 |
| 17 | 150 | 6.8 | 0.980 | 1.00 | 0.0033 | 0.62 | 8 |
| 18 | 150 | 6.7 | 0.977 | 0.99 | 0.0030 | 0.89 | 8 |
| 19 | 150 | 6.6 | 0.985 | 0.99 | 0.0032 | 3.60 | 10 |
| 20 | 150 | 6.7 | 0.977 | 0.99 | 0.0034 | 7.80 | 15 |
| 21 | 150 | 6.5 | 0.982 | 1.00 | 0.0028 | 7.40 | 15 |
| 22 | 150 | 7.0 | 0.984 | 1.00 | 0.0030 | 7.10 | 15 |
| 23 | 150 | 7.0 | 0.983 | 0.99 | 0.0031 | 0.35 | 5 |
| 24 | 150 | 6.8 | 0.978 | 0.99 | 0.0035 | 0.33 | 6 |
| 25 | 150 | 6.8 | 0.982 | 0.99 | 0.0032 | 1.88 | 8 |
| 26 | 150 | 7.0 | 0.978 | 0.99 | 0.0028 | 0.27 | 5 |
| 27 | 150 | 6.7 | 0.978 | 0.99 | 0.0035 | 0.33 | 5 |
| 28 | 150 | 6.5 | 0.981 | 0.99 | 0.0028 | 0.28 | 5 |
| Comparative Example | | | | | | | |
| 1 | — | 6.9 | 0.980 | 1.00 | 0.0036 | 0.89 | 15 |
| 2 | 150 | 6.7 | 0.977 | 1.00 | 0.0029 | 0.92 | 13 |
| 3 | 150 | 6.6 | 0.977 | 1.00 | 0.0028 | 0.48 | 12 |
| 4 | 150 | 7.0 | 0.977 | 1.00 | 0.0033 | 0.22 | 13 |
| 5 | 150 | 6.6 | 0.980 | 0.98 | 0.0031 | 0.34 | 14 |
| 6 | 2000 | 6.8 | 0.981 | 1.00 | 0.0031 | 3.50 | 20 |

TABLE 2

| | Environment | | | | | | | | | | | |
|---|---|---|---|---|---|---|---|---|---|---|---|---|
| | High-temp. high-humidity | | | | Normal-temp. normal-humidity | | | | Low-temp. Low-humidity | | | |
| | Image density | Image fog | Maximum fog on photosensitive member | Charging roller contamination | Image density | Image fog | Maximum fog on photosensitive member | Charging roller contamination | Image density | Image fog | Maximum fog on photosensitive member | Charging roller contamination member |
| Example | | | | | | | | | | | | |
| 1 | A | A | A | A | A | A | A | A | A | A | A | A |
| 2 | A | A | A | A | A | A | A | A | A | A | A | A |
| 3 | A | A | A | A | A | A | A | A | A | A | A | A |
| 4 | A | A | A | A | A | A | A | A | A | A | A | B |
| 5 | A | A | B | A | A | A | A | A | A | A | A | B |
| 6 | A | A | B | A | A | A | B | A | A | A | B | B |
| 7 | A | A | B | B | A | A | B | B | A | B | B | B |
| 8 | A | B | B | B | A | B | B | B | B | B | B | C |
| 9 | A | B | B | A | A | B | B | A | A | B | B | B |
| 10 | B | B | C | A | B | B | B | A | B | B | B | B |
| 11 | B | B | C | A | B | B | B | A | B | B | B | B |
| 12 | B | B | B | A | B | B | B | A | B | B | B | B |
| 13 | A | B | B | A | A | B | B | A | B | B | B | B |
| 14 | A | A | A | A | A | A | B | B | B | B | C | C |
| 15 | A | A | A | A | A | A | A | A | A | A | A | A |
| 16 | A | A | A | A | A | A | A | A | A | A | A | A |
| 17 | A | A | A | A | A | A | A | A | A | A | A | A |
| 18 | A | A | A | A | A | A | A | A | A | A | A | B |
| 19 | A | A | B | A | A | A | B | A | A | B | B | C |
| 20 | A | B | B | A | A | B | B | B | B | B | B | C |
| 21 | A | B | B | A | A | B | B | B | B | B | B | C |
| 22 | A | B | B | A | A | B | B | B | B | B | B | C |
| 23 | A | A | A | A | A | A | A | A | A | A | A | A |
| 24 | A | B | B | A | A | A | A | A | A | A | A | A |
| 25 | A | C | C | A | A | B | B | A | A | A | A | A |
| 26 | A | A | A | A | A | A | A | A | A | A | A | A |
| 27 | A | A | A | A | A | A | A | A | A | A | A | A |
| 28 | A | A | A | A | A | A | A | A | A | A | A | A |
| Comparative Example | | | | | | | | | | | | |
| 1 | A | B | B | A | A | B | B | C | B | B | C | D |
| 2 | A | C | C | A | A | B | C | B | B | B | C | C |
| 3 | A | C | C | A | A | B | C | B | B | B | C | C |
| 4 | A | C | C | A | A | B | C | B | B | B | C | C |
| 5 | A | C | B | A | A | C | C | B | B | C | C | C |
| 6 | A | B | B | A | A | B | C | C | B | B | C | D |

Example 29

Next, using a full-color printer LBP2510 (manufactured by CANON INC.), Toner (1), Toner (26), Toner (27) and Toner (28) were put into a cyan cartridge, a yellow cartridge, a magenta cartridge and a black cartridge, respectively, of the printer each in an amount of 150 g, and full-color images were formed on 5,000 sheets. Evaluation was made in the same manner as in Example 1, and the results obtained are shown in Table 3.

TABLE 3

| | Environment | | | | | | | |
|---|---|---|---|---|---|---|---|---|
| | High-temp. high-humidity | | | | Low-temp. Low-humidity | | | |
| | Image density | Image fog | Maximum fog on photosensitive member | Charging roller contamination | Image density | Image fog | Maximum fog on photosensitive member | Charging roller contamination |
| Example 29 | A | A | A | A | A | A | A | A |

What is claimed is:

1. A non-magnetic toner comprising non-magnetic toner particles containing at least a binder resin and a colorant, and an inorganic fine powder;

said non-magnetic toner particles containing at least one compound of compounds represented by the following structural formulas; said at least one compound being in a content of from 5 ppm to 1,000 ppm based on the weight of the toner:

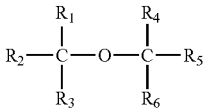

wherein $R_1$ to $R_6$ each represent an alkyl group having 1 to 6 carbon atoms, and may be the same with or different from one another; and

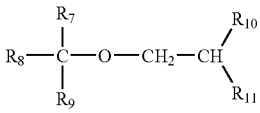

wherein $R_7$ to $R_{11}$ each represent an alkyl group having 1 to 6 carbon atoms, and may be the same with or different from one another.

2. The non-magnetic toner according to claim 1, wherein said at least one compound is in a content of from 10 ppm to 800 ppm.

3. The non-magnetic toner according to claim 1, wherein said at least one compound is in a content of from 10 ppm to 500 ppm.

4. The non-magnetic toner according to claim 1, wherein said compounds are compounds represented by the following structural formulas:

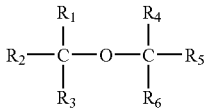

wherein $R_1$ to $R_6$ each represent an alkyl group having 1 to 4 carbon atoms, and may be the same with or different from one another; and

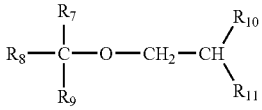

wherein $R_7$ to $R_{11}$ each represent an alkyl group having 1 to 4 carbon atoms, and may be the same with or different from one another.

5. The non-magnetic toner according to claim 1, wherein said compounds are compounds represented by the following structural formulas:

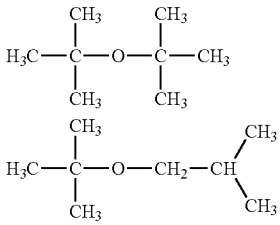

6. The non-magnetic toner according to claim 1, which has an average circularity of from 0.940 to 0.995 and a weight-average particle diameter D4 of from 3 μm to 10 μm.

7. The non-magnetic toner according to claim 1, which has an average circularity of from 0.960 to 0.995 and a weight-average particle diameter D4 of from 4 μm to 8 μm.

8. The non-magnetic toner according to claim 1, which has a mode circularity of 0.99 or more.

9. The non-magnetic toner according to claim 1, which further comprises a resin having sulfur atoms.

10. The non-magnetic toner according to claim 9, wherein the ratio of atomic % by number (E) of sulfur atoms present at toner particle surface portions to atomic % by number (A)

of carbon atoms present at toner particle surface portions, E/A, as measured by X-ray photoelectric spectrophotometry is from 0.0003 to 0.0050.

11. The non-magnetic toner according to claim 1, wherein said inorganic fine powder has an average primary particle diameter of from 4 nm to 80 nm, and is contained in the toner in an amount of from 0.1% by weight to 4% by weight.

12. The non-magnetic toner according to claim 1, wherein said inorganic fine powder is a powder selected from the group consisting of fine powders of silica, titanium oxide and alumina or a double oxide of any of these.

13. The non-magnetic toner according to claim 1, wherein said inorganic fine powder is subjected to hydrophobic treatment with at least a silicone oil.

14. The non-magnetic toner according to claim 1, wherein said inorganic fine powder is subjected to hydrophobic treatment with at least a silane compound and a silicone oil.

15. The non-magnetic toner according to claim 1, wherein said inorganic fine powder has a liberation percentage of from 0.05% to 10.00%.

16. The non-magnetic toner according to claim 1, wherein said inorganic fine powder has a liberation percentage of from 0.10% to 5.00%.

17. The non-magnetic toner according to claim 1, wherein said inorganic fine powder has a liberation percentage of from 0.10% to 3.00%.

18. The non-magnetic toner according to claim 1, wherein said non-magnetic toner particles are particles produced in water.

19. The non-magnetic toner according to claim 1, which shows negative chargeability.

20. The non-magnetic toner according to claim 1, wherein, in the measurement of hydrophobicity of the toner, making use of a water/methanol mixed medium, the methanol concentration ($C_S$:% by volume) at hydrophobicity drop start point and the methanol concentration ($C_E$% by volume) at hydrophobicity drop end point satisfy the following relation:

$$3 \leqq \{(C_E)-(C_S)\} \leqq 15.$$

* * * * *

UNITED STATES PATENT AND TRADEMARK OFFICE

CERTIFICATE OF CORRECTION

PATENT NO. : 7,112,393 B2
APPLICATION NO. : 10/533513
DATED : September 26, 2006
INVENTOR(S) : Keiji Komoto et al.

It is certified that error appears in the above-identified patent and that said Letters Patent is hereby corrected as shown below:

COLUMN 8:

Line 57, "specified. 2)" should read --specified. ¶ 2)--.

COLUMN 21:

Line 36, "diner." should read --dimer.--.

Signed and Sealed this

Third Day of April, 2007

JON W. DUDAS
*Director of the United States Patent and Trademark Office*

UNITED STATES PATENT AND TRADEMARK OFFICE

CERTIFICATE OF CORRECTION

PATENT NO. : 7,112,393 B2
APPLICATION NO. : 10/764531
DATED : September 26, 2006
INVENTOR(S) : Keiji Komoto et al.

It is certified that error appears in the above-identified patent and that said Letters Patent is hereby corrected as shown below:

COLUMN 8:

Line 57, "specified. 2)" should read --specified. ¶ 2)--.

COLUMN 21:

Line 36, "diner." should read --dimer.--.

This certificate supersedes Certificate of Correction issued April 3, 2007.

Signed and Sealed this

Eighth Day of May, 2007

JON W. DUDAS
*Director of the United States Patent and Trademark Office*

UNITED STATES PATENT AND TRADEMARK OFFICE

CERTIFICATE OF CORRECTION

PATENT NO. : 7,112,393 B2
APPLICATION NO. : 10/764531
DATED : September 26, 2006
INVENTOR(S) : Keiji Komoto et al.

It is certified that error appears in the above-identified patent and that said Letters Patent is hereby corrected as shown below:

ON THE TITLE PAGE [56] REFERENCES CITED:

Foreign Patent Documents,
"JP 02-555480 2/2000" should read --JP 2002-555480 2/2000--.

COLUMN 8:

Line 57, "specified. 2)" should read --specified. ¶ 2)--.

COLUMN 21:

Line 36, "diner." should read --dimer.--.

COLUMN 15:

Line 1, "2,2'-bis[4-(acryloxy.diethoxy)phenyl]propane," should read --2,2'-bis[4-(acryloxy diethoxy)phenyl]propane,--;
Line 9, "acryloxy.diethoxy)phenyl]propane," should read --acryloxy diethoxy)phenyl]propane,--; and
Line 10, "methacryloxy.polyethoxy)phenyl]propane," should read --methacryloxy polyethoxy)phenyl]propane,--.

COLUMN 58:

Line 15, "($C_E$%" should read --($C_E$: %--.

Signed and Sealed this

Sixteenth Day of October, 2007

JON W. DUDAS
*Director of the United States Patent and Trademark Office*